US008014693B2

(12) United States Patent
Kadokura

(10) Patent No.: US 8,014,693 B2
(45) Date of Patent: Sep. 6, 2011

(54) IMAGE FORMING APPARATUS HAVING IMPROVED SERVICEABILITY

(75) Inventor: Kazuyuki Kadokura, Atsugi (JP)

(73) Assignee: Ricoh Company, Ltd, Tokyo (JP)

( * ) Notice: Subject to any disclaimer, the term of this patent is extended or adjusted under 35 U.S.C. 154(b) by 0 days.

(21) Appl. No.: 12/573,530

(22) Filed: Oct. 5, 2009

(65) Prior Publication Data

US 2010/0086317 A1 Apr. 8, 2010

(30) Foreign Application Priority Data

Oct. 6, 2008 (JP) ..... 2008-259740
Oct. 6, 2008 (JP) ..... 2008-259826
Aug. 6, 2009 (JP) ..... 2009-183608
Aug. 6, 2009 (JP) ..... 2009-183625

(51) Int. Cl.
*G03G 15/00* (2006.01)

(52) U.S. Cl. ..... 399/81; 399/11

(58) Field of Classification Search ..... 399/11, 399/80, 81
See application file for complete search history.

(56) References Cited

U.S. PATENT DOCUMENTS 6,314,249 B1 * 11/2001 Lay et al. ..... 399/81

FOREIGN PATENT DOCUMENTS

| | | |
|---|---|---|
| JP | 4-277775 | 10/1992 |
| JP | 10-83110 | 3/1998 |
| JP | 2001-202436 | 7/2001 |
| JP | 2002-244503 | 8/2002 |
| JP | 2003-114958 | 4/2003 |
| JP | 2005-228258 | 8/2005 |
| JP | 2006-23475 | 1/2006 |
| JP | 2007-51006 | 3/2007 |
| JP | 2008-204078 | 9/2008 |

* cited by examiner

*Primary Examiner* — Hoang Ngo
(74) *Attorney, Agent, or Firm* — Oblon, Spivak, McClelland, Maier & Neustadt, L.L.P.

(57) ABSTRACT

An image forming apparatus including maintenance function for maintaining the image forming apparatus at a given operating condition includes an operation screen unit. The operation screen unit is useable for conducting maintenance on the image forming apparatus. The maintenance is categorized into a service-maintenance work conductable by a service engineer within service-operation content, and a user-maintenance work conductable by a user within user-allowed-operation content. The operation screen unit includes a user-specific operation screen, with which the user-maintenance work is conductable for adjusting the maintenance function within the user-allowed-operation content. The user-specific operation screen displays the user-allowed-operation content, which is different from the service-operation content.

8 Claims, 18 Drawing Sheets

SERVICE SETTING INFORMATION TABLE (152, 151, 153, 154, 155, 156, 150)

| FIRST CLASSIFICATION | SECOND CLASSIFICATION | DEFAULT VALUE | MINIMUM VALUE | MAXIMUM VALUE | STEP VALUE |
|---|---|---|---|---|---|
| 1710 | 1 | 0.0 | −10.0 | 10.0 | 0.1 |
| 1711 | 1 | 0.0 | −10.0 | 10.0 | 0.1 |
| 1711 | 2 | 0.0 | −10.0 | 10.0 | 0.1 |
| 1711 | 3 | 0.0 | −10.0 | 10.0 | 0.1 |
| 1711 | 4 | 0.0 | −10.0 | 10.0 | 0.1 |
| 1711 | 5 | 0.0 | −10.0 | 10.0 | 0.1 |
| 1711 | 6 | 0.0 | −10.0 | 10.0 | 0.1 |
| 1711 | 7 | 0.0 | −10.0 | 10.0 | 0.1 |
| 1711 | 8 | 0.0 | −10.0 | 10.0 | 0.1 |
| 1711 | 9 | 0.0 | −10.0 | 10.0 | 0.1 |
| 1711 | 10 | 0.0 | −10.0 | 10.0 | 0.1 |
| 1810 | 1 | 0.0 | −10.0 | 10.0 | 0.1 |
| 1811 | 1 | 0.0 | −10.0 | 10.0 | 0.1 |
| 1811 | 2 | 0.0 | −10.0 | 10.0 | 0.1 |
| 1811 | 3 | 0.0 | −10.0 | 10.0 | 0.1 |
| 7680 | 1 | 2 | −5 | 5 | 1 |
| 7690 | 1 | 0.0 | 0.0 | 7.5 | 0.5 |
| 7690 | 2 | 0.0 | 0.0 | 15.0 | 0.5 |
| 7690 | 3 | 0.0 | 0.0 | 7.5 | 0.5 |

USER SETTING INFORMATION TABLE (162, 161, 163, 164, 165, 166, 160)

| FIRST CLASSIFICATION | SECOND CLASSIFICATION | DEFAULT VALUE | MINIMUM VALUE | MAXIMUM VALUE | STEP VALUE |
|---|---|---|---|---|---|
| 1710 | 1 | 0.0 | −5.0 | 5.0 | 0.1 |
| 1711 | 1 | 0.0 | −5.0 | 5.0 | 0.1 |
| 1711 | 2 | 0.0 | −5.0 | 5.0 | 0.1 |
| 1711 | 3 | 0.0 | −5.0 | 5.0 | 0.1 |
| 1711 | 4 | 0.0 | −5.0 | 5.0 | 0.1 |
| 1711 | 5 | 0.0 | −5.0 | 5.0 | 0.1 |
| 1711 | 6 | 0.0 | −5.0 | 5.0 | 0.1 |
| 1711 | 7 | 0.0 | −5.0 | 5.0 | 0.1 |
| 1711 | 8 | 0.0 | −5.0 | 5.0 | 0.1 |
| 1711 | 9 | 0.0 | −5.0 | 5.0 | 0.1 |
| 1711 | 10 | 0.0 | −5.0 | 5.0 | 0.1 |
| 1810 | 1 | 0.0 | −5.0 | 5.0 | 0.1 |
| 1811 | 1 | 0.0 | −5.0 | 5.0 | 0.1 |
| 1811 | 2 | 0.0 | −5.0 | 5.0 | 0.1 |
| 1811 | 3 | 0.0 | −5.0 | 5.0 | 0.1 |
| 7680 | 1 | 2 | −3 | 3 | 1 |
| 7690 | 1 | 0.0 | 0.0 | 5.0 | 0.5 |
| 7690 | 2 | 0.0 | 0.0 | 12.0 | 0.5 |
| 7690 | 3 | 0.0 | 0.0 | 5.0 | 0.5 |

FIG. 6A 153 154 155

152 151 156 150

| SERVICE SETTING INFORMATION TABLE | | | | | |
|---|---|---|---|---|---|
| FIRST CLASSIFICATION | SECOND CLASSIFICATION | DEFAULT VALUE | MINIMUM VALUE | MAXIMUM VALUE | STEP VALUE |
| 1710 | 1 | 0.0 | −10.0 | 10.0 | 0.1 |
| 1711 | 1 | 0.0 | −10.0 | 10.0 | 0.1 |
| 1711 | 2 | 0.0 | −10.0 | 10.0 | 0.1 |
| 1711 | 3 | 0.0 | −10.0 | 10.0 | 0.1 |
| 1711 | 4 | 0.0 | −10.0 | 10.0 | 0.1 |
| 1711 | 5 | 0.0 | −10.0 | 10.0 | 0.1 |
| 1711 | 6 | 0.0 | −10.0 | 10.0 | 0.1 |
| 1711 | 7 | 0.0 | −10.0 | 10.0 | 0.1 |
| 1711 | 8 | 0.0 | −10.0 | 10.0 | 0.1 |
| 1711 | 9 | 0.0 | −10.0 | 10.0 | 0.1 |
| 1711 | 10 | 0.0 | −10.0 | 10.0 | 0.1 |
| 1810 | 1 | 0.0 | −10.0 | 10.0 | 0.1 |
| 1811 | 1 | 0.0 | −10.0 | 10.0 | 0.1 |
| 1811 | 2 | 0.0 | −10.0 | 10.0 | 0.1 |
| 1811 | 3 | 0.0 | −10.0 | 10.0 | 0.1 |
| 7680 | 1 | 2 | −5 | 5 | 1 |
| 7690 | 1 | 0.0 | 0.0 | 7.5 | 0.5 |
| 7690 | 2 | 0.0 | 0.0 | 15.0 | 0.5 |
| 7690 | 3 | 0.0 | 0.0 | 7.5 | 0.5 |

FIG. 6B

USER SETTING INFORMATION TABLE

| FIRST CLASSIFICATION (161) | SECOND CLASSIFICATION (162) | DEFAULT VALUE (163) | MINIMUM VALUE (164) | MAXIMUM VALUE (165) | STEP VALUE (166) |
|---|---|---|---|---|---|
| 1710 | 1 | 0.0 | −5.0 | 5.0 | 0.1 |
| 1711 | 1 | 0.0 | −5.0 | 5.0 | 0.1 |
| 1711 | 2 | 0.0 | −5.0 | 5.0 | 0.1 |
| 1711 | 3 | 0.0 | −5.0 | 5.0 | 0.1 |
| 1711 | 4 | 0.0 | −5.0 | 5.0 | 0.1 |
| 1711 | 5 | 0.0 | −5.0 | 5.0 | 0.1 |
| 1711 | 6 | 0.0 | −5.0 | 5.0 | 0.1 |
| 1711 | 7 | 0.0 | −5.0 | 5.0 | 0.1 |
| 1711 | 8 | 0.0 | −5.0 | 5.0 | 0.1 |
| 1711 | 9 | 0.0 | −5.0 | 5.0 | 0.1 |
| 1711 | 10 | 0.0 | −5.0 | 5.0 | 0.1 |
| 1810 | 1 | 0.0 | −5.0 | 5.0 | 0.1 |
| 1811 | 1 | 0.0 | −5.0 | 5.0 | 0.1 |
| 1811 | 2 | 0.0 | −5.0 | 5.0 | 0.1 |
| 1811 | 3 | 0.0 | −5.0 | 5.0 | 0.1 |
| 7680 | 1 | 2 | −3 | 3 | 1 |
| 7690 | 1 | 0.0 | 0.0 | 5.0 | 0.5 |
| 7690 | 2 | 0.0 | 0.0 | 12.0 | 0.5 |
| 7690 | 3 | 0.0 | 0.0 | 5.0 | 0.5 |

160

IMAGE FORMING APPARATUS HAVING IMPROVED SERVICEABILITY

CROSS-REFERENCE TO RELATED APPLICATIONS

This application claims priority to Japanese Patent Application Nos. 2008-259740, filed on Oct. 6, 2008, 2008-259826, filed on Oct. 6, 2008, 2009-183608, filed on Aug. 6, 2009, and 2009-183625, filed on Aug. 6, 2009 in the Japan Patent Office, which are hereby incorporated by reference herein in their entirety.

BACKGROUND OF THE INVENTION

1. Field of the Invention

The present invention relates to an image forming apparatus employing electrophotography, such as a printer, a copier, a facsimile machine, or a multi-functional apparatuses using several functions, and more particularly, to setting operating parameters by a user of such an image forming apparatus, and maintenance work such as consumable-supply replacement.

2. Description of the Background Art

In general, image forming apparatuses (e.g., a copier using electrophotography) typically require periodic maintenance, and may require repair in the event of a malfunction. Nevertheless, with such maintenance, image forming apparatuses can be effectively maintained in good operating condition over time.

The specific conditions under which such apparatuses may require maintenance include movement/arrangement fluctuation of mechanical devices or degradation of materials and components of the apparatus over time, as well as consumable supply consumption/degradation such as of a developer, for example. The maintenance involved to solve such condition change may be adjustment of operating parameters of apparatus, repair/replacement of parts, and refilling/replacement of consumable supply. Such maintenance is typically conducted by a service engineer, who is a technician skilled in maintenance work.

In offices or the like, image forming apparatuses may be used for image forming operations under a default operating parameters setting or normal operating parameters setting, or image forming apparatuses may be used for image forming operation by changing and setting operating parameters of image forming operation by a user using an operation panel (e.g., touch panel).

In general, image forming operation of image forming apparatuses can be changed and set to given conditions by a user because the user may need such operating parameters change. For example, a user can select image forming operation such as monochrome or multi-color image forming operation, image concentration, the number of sheets to be output, etc. Such operating parameters change can be conducted within a user-settable conditioning range, which may be embedded for image forming apparatuses. Further, the user may conduct refilling of consumable supply such as toner refilling.

As such, the user can adjust operating parameters of image forming apparatuses or refill consumable supply conditions of image forming apparatuses to obtain desired output.

However, when image forming apparatuses need special maintenance, such special maintenance is conducted by a service engineer trained in maintenance instead of a user untrained (hereinafter, may be referred "untrained user"). For example, when operating parameters of an apparatus move outside a normal range, the service engineer adjusts operating parameters to the normal range, or when special maintenance requiring special care to avoid damage to the apparatus is required, the service engineer conducts such special maintenance work.

Recently, however, there is increasing demand for enhanced usability of image forming apparatuses. Such demand includes, for example, enhanced freedom of setting operating parameters by the user in order to save time and effort. In other words, although most types of special maintenance may still need to be carried out by a trained service engineer, there is a demand that some kinds of special maintenance be able to be carried out by an untrained user.

An example of such demand of enhanced usability for setting operating parameters may be as follows: Image forming apparatuses such as a copier using electrophotography may include a finisher, which processes a recording sheet having an image developed thereon. For example, the finisher may include a stapler and a punch, whose positions may need to be adjusted as may the position of recording sheet at an image transfer process point. Typically, such mechanical adjustment may be set for image forming apparatuses before the apparatuses are shipped using a standard recording sheet (e.g., stapling and hole punching positions are set using the standard recording sheet).

As described above, when a user uses an image forming apparatus, the user may set given operating parameters to obtain desired output for image forming operation. In such operating parameters setting, the user can set certain parameters. For example, the user can select recording sheet size and type, whether stapling and hole punching is conducted, and if the latter, the hole punching position.

However, the user cannot make fine mechanical adjustments to correct the position of stapling and hole punching (which may also be referred to as fine positioning). Accordingly, if a user uses a recording sheet other than the standard sheet used for parameter setting at the factory, the standard setting for image forming apparatus may not be adequate for such recording sheet made of different material. In such situation, re-adjustment of mechanical parameter setting (e.g., change of setting of image forming condition or post-processing unit or system) is required. However, such re-adjustment may need to be conducted by a service engineer.

In light of such demand for greater usability, some image forming apparatuses that allow some mechanical parameter adjustment by user operation have been proposed.

For example, JP-2006-023475-A discusses an image forming apparatus having an image forming unit, a post-processing unit, and an adjustment device, in which the adjustment device can be used to adjust the mechanical parameters of the image forming unit and the post-processing unit. Such image forming apparatus uses multiple modes, such as a job mode such as a normal mode for image forming operation or a print-confirmation mode, and an adjustment mode for adjusting mechanical parameters using the adjustment device. Some adjustments in the adjustment mode can be conducted by information input by a user using an operation panel or the like.

JP-2007-051006-A discusses an image forming apparatus having a post-processing unit used for post-processing of an image-formed recording sheet, in which mechanical adjustment for the post-processing unit may be changed for each job.

JP-2002-244503-A discusses an image forming apparatus having an ability to display information on the image forming operation the contents of which changes depending on the person making the adjustment, to enhance efficiency for adjustment in an adjustment mode. Specifically, display information and display sequence of the adjustment mode is changed based on whether the person making the adjustment is a manufacturer, a customer engineer, a design engineer, and so forth. Such an arrangement can prevent selection of mistaken information, enabling the adjustment process to be conducted efficiently.

Separately, there is also demand for enhanced ease of that maintenance which is usually conducted by a trained service engineer. For example, image forming apparatuses using electrophotography typically use two-component developer composed of carrier particles and toner particles. Over time, a coating agent disposed on surfaces of carrier particles of the toner to enhance frictional electrification may fall off, or toner particles may adhere to surfaces of the carrier particles. If such phenomenon occurs, charging performance of carrier particles may deteriorate, thus shortening the service life of the developer.

Conventionally, image forming apparatuses may use developer having a given service life. When the end of that service life is reached, a development unit in which the developer is contained is removed from the image forming apparatus, degraded developer is removed from the development unit, and the development unit is refilled with new developer. In such developer replacement operation, an upper cover of the development unit must be opened for the developer replacement to remove the developer from the development unit. Accordingly, such developer replacement operation may need to be conducted by a trained service engineer.

In addition, recently, image forming apparatuses have been used for various purposes with high-speed printing, which increases the replacement frequency of the developer. In light of such situation, simplification of replacement work and time-saving of replacement work have been demanded.

In view of such demand, JP-H10-83110-A discusses an image forming apparatus including a storage vessel and a recovery vessel, wherein both vessels are detachably mounted in the image forming apparatus. The storage vessel stores fresh developer (i.e., non-used developer) to be used as replacement developer, and the recovery vessel recovers used developer. In such image forming apparatus, used developer is recovered and fresh developer is supplied to replace developer based on a measured developer replacement timing. Further, such developer replacement can be conducted reliably even if an abnormal event such as abrupt power-shutdown occurs during replacement of developer.

Further, JP-H4-277775-A discusses an image forming apparatus including a development unit, in which developer can be replaced while attaching the development unit in the image forming apparatus.

However, the image forming apparatus of JP-2006-023475-A is designed so that although an untrained user can make some mechanical adjustments, most mechanical adjustments must still be conducted by a trained service engineer. Accordingly, if the untrained user conducts adjustments of image forming parameters or of the image forming apparatus itself that are normally conducted by a trained service engineer, image forming parameters may not be maintained within an adequate range, which may result in degraded and may further prevent the image forming apparatus from operating as designed.

The image forming apparatus of JP-2007-051006-A has a design similar to that of the apparatus of JP-2006-023475-A, in that an untrained user can make some mechanical adjustments but most mechanical adjustments must still be conducted by a trained service engineer. Accordingly, a problem similar to that of JP-2006-023475-A may also occur, in that if the untrained user conducts adjustment of image forming apparatus, the quality of image formation may be degraded.

The image forming apparatus of JP-2002-244503-A has a design similar to those of JP-2006-023475-A and JP-2007-051006-A, and thus has the same problems.

Further, the image forming apparatuses of JP-H10-83110-A and JP-H4-277775-A need spaces to set the storage vessel storing replacement developer and the recovery vessel for recovering developer in the image forming apparatus, which increases a size of the image forming apparatus.

As described above, as for conventional image forming apparatuses, maintenance work such as developer replacement may be conducted by a service engineer but not a user.

SUMMARY

In one aspect of the present invention, an image forming apparatus including maintenance function for maintaining the image forming apparatus in a given operating condition includes an operation screen unit. The operation screen unit is useable for conducting maintenance on the image forming apparatus. The maintenance is categorized into a service-maintenance work conductable by a service engineer within a range of service operations (service-operation content) and a user-maintenance work conductable by a user within a range of user-allowed operations (user-allowed-operation content). The operation screen unit includes a user-specific operation screen that displays the user-allowed-operation content, with which the user-maintenance work is conductable for adjusting of the maintenance function within the user-allowed-operation content. The user-allowed-operation content and the service-operation content are different.

In another aspect of the present invention, an image forming apparatus includes a user-setting function and a service-setting function. The user-setting function sets one or more selections as operating parameters of the image forming apparatus as a user adjustment range. The selections are adjustable by a user in view of apparatus-use environment. The service-setting function sets one or more selections as operating parameters of the image forming apparatus as a service adjustment range. The selections are adjustable by a service engineer in view of service maintenance work conductable by the service engineer. The selections settable by the user-setting function at least partially correspond to the selections set by the service-setting function. The user adjustment range and the service adjustment range are independently operable for setting one or more selections.

In another aspect of the present invention, an image forming apparatus including maintenance function for maintaining the image forming apparatus in a given operating condition includes an operation screen unit. The operation screen unit is useable for conducting maintenance on the image forming apparatus. The maintenance includes a user-maintenance work conductable by a user. The operation screen unit includes a user-specific operation screen, with which the user-maintenance work is conductable. The user-specific operation screen displays a first screen and a second screen for the user maintenance work. The first screen accepts input information by the user, and the second screen requests the user to conduct a given action for the user maintenance work.

BRIEF DESCRIPTION OF THE DRAWINGS

A more complete appreciation of the disclosure and many of the attendant advantages and features thereof can be readily obtained and understood from the following detailed description with reference to the accompanying drawings, wherein:

FIG. 6 shows an example user setting information table and an example service setting information table;

Figure 1:
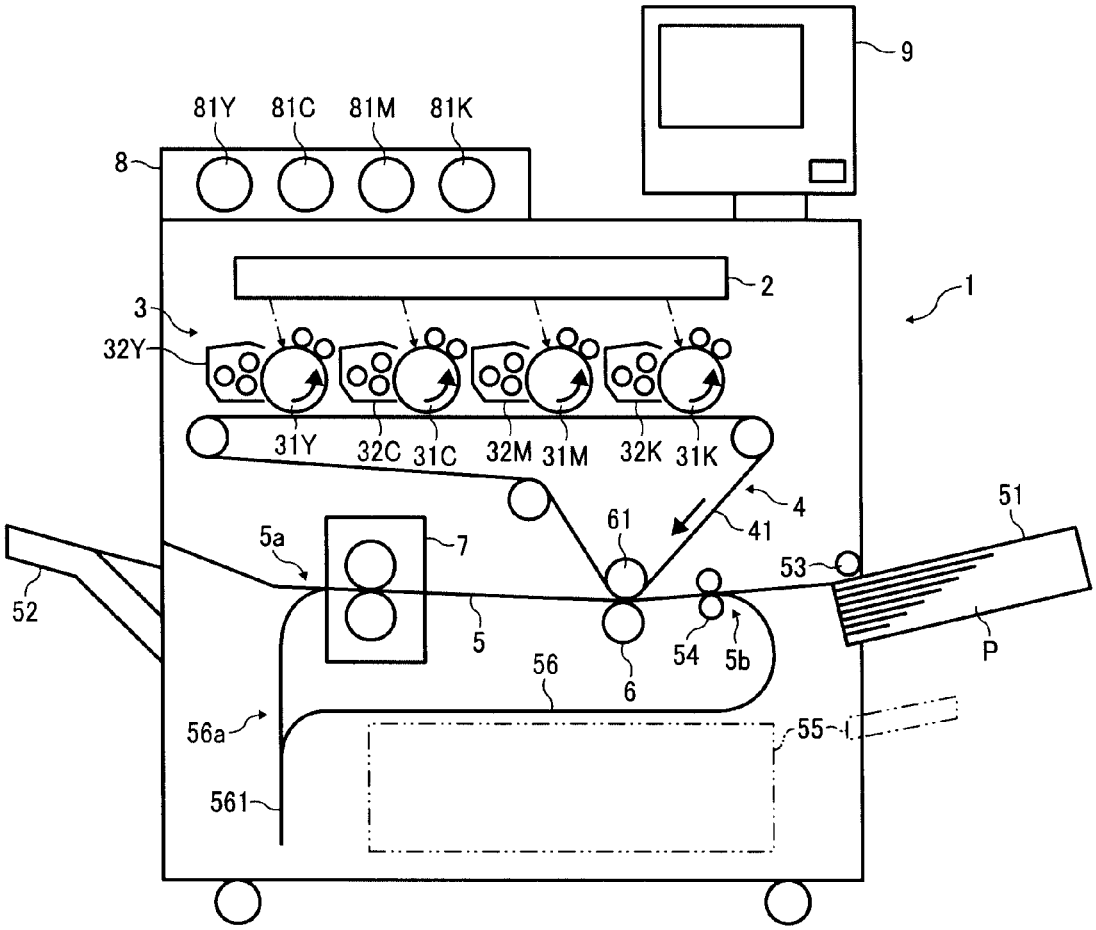
FIG. 1 illustrates a schematic configuration of an image forming apparatus according to an example embodiment.

The accompanying drawings are intended to depict exemplary embodiments of the present invention and should not be interpreted to limit the scope thereof. The accompanying drawings are not to be considered as drawn to scale unless explicitly noted, and identical or similar reference numerals designate identical or similar components throughout the several views.

DETAILED DESCRIPTION OF EXEMPLARY EMBODIMENTS

A description is now given of exemplary embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Furthermore, although in describing expanded views shown in the drawings, specific terminology is employed for the sake of clarity, the present disclosure is not limited to the specific terminology so selected and it is to be understood that each specific element includes all technical equivalents that operate in a similar manner.

Referring now to the drawings, an image forming apparatus according to an exemplary embodiment is described. The image forming apparatus may be copier employing an electrophotography system, for example, but not limited thereto.

FIG. 1 illustrates a schematic configuration of an image forming apparatus 1. The image forming apparatus 1 includes an optical writing unit 2, an image forming unit 3, an intermediate transfer unit 4, and a fixing unit 7, for example. The image forming unit 3, used as an image forming engine, may include photoconductor drums 31K, 31M, 31C, 31Y, and development units 32K, 32M, 32C, 32Y for black, magenta, cyan, yellow toner, for example. The intermediate transfer unit 4 disposed under the image forming unit 3 may include an intermediate transfer belt 41, which is driven by a drive unit and travels in a direction shown by an arrow. The photoconductor drums 31K, 31M, 31C, and 31Y are disposed along an extended flat face of the intermediate transfer belt 41. A recording sheet P (recording medium) passes under the intermediate transfer unit 4 to form an image on the recording sheet P.

The image forming apparatus 1 may further include a sheet feed tray 51, which can store a given volume of the recording sheet P. The image forming apparatus 1 may include a sheet transportation route 5 extended from the sheet feed tray 51 to a sheet ejection tray 52 to transport of the recording sheet P for image forming operation. The sheet feed tray 51 may include a plurality of trays, and thereby different sized recording sheet can be stored or sheet-orientation-changed recording sheet can be stored in the plurality of trays. The sheet feed tray 51 may include an upper tray and a lower tray, for example. The sheet feed tray 51 may be provided with a sheet feed roller 53. Further, the image forming apparatus 1 may include a registration roller 54, a secondary transfer roller 6, and the fixing unit 7 disposed along the sheet transportation route 5.

Further, the image forming apparatus 1 may include a sheet reversing transportation route 56, connected to the sheet transportation route 5, which is used for double-face recording. The sheet reversing transportation route 56 includes a position 5*a*, a position 5*b*, and a reversing portion 561 between the position 5*a* and position 5*b*. The position 5*a* is set at a position that passes the fixing unit 7 in the sheet transportation route 5, and the position 5*b* is set before the registration roller 54 in the sheet transportation route 5. A switch claw may be disposed at the position 5*a* to switch a sheet transportation direction of the recording sheet P to the sheet ejection tray 52 or to the sheet reversing transportation route 56. Further, another switch claw may be disposed at a reversing position 56*a* in the sheet reversing transportation route 56. The recording sheet P enters the reversing portion 561 and passes the reversing position 56*a*, and then the recording sheet P is transported to the position 5*b* by changing the sheet transportation direction by another switch claw. With such configuration, faces of the recording sheet P can be inverted, and a back face is fed to the registration roller 54 as a recording face.

Further, the image forming apparatus 1 may include a sheet feed unit 55 as an option unit. The sheet feed unit 55 may be three-decked A4 size trays, a manual feed tray, one-decked A3 size tray (for first machine) and two-decked A3 size trays (for second machine), for example.

The secondary transfer roller 6, disposed at a given position of the intermediate transfer belt 41, transfers an image from the intermediate transfer belt 41 to the recording sheet P. A secondary transfer backup roller 61 is disposed at a counter position of secondary transfer roller 6 via the intermediate transfer belt 41.

The fixing unit 7 fixes the transferred image on the recording sheet P by applying heat and pressure using a fixing belt and a pressure roller, for example.

The image forming apparatus 1 may further include a cartridge compartment 8 at its upper portion. The cartridge compartment 8 may be used to detachably mount toner cartridges 81K, 81M, 81C, and 81Y for black, magenta, cyan, yellow in the image forming apparatus 1. Further, the image forming apparatus 1 may include an operation unit 9 on its upper face, wherein the operation unit 9 may attached to the upper face of the image forming apparatus 1 using a support member.

Figure 2:
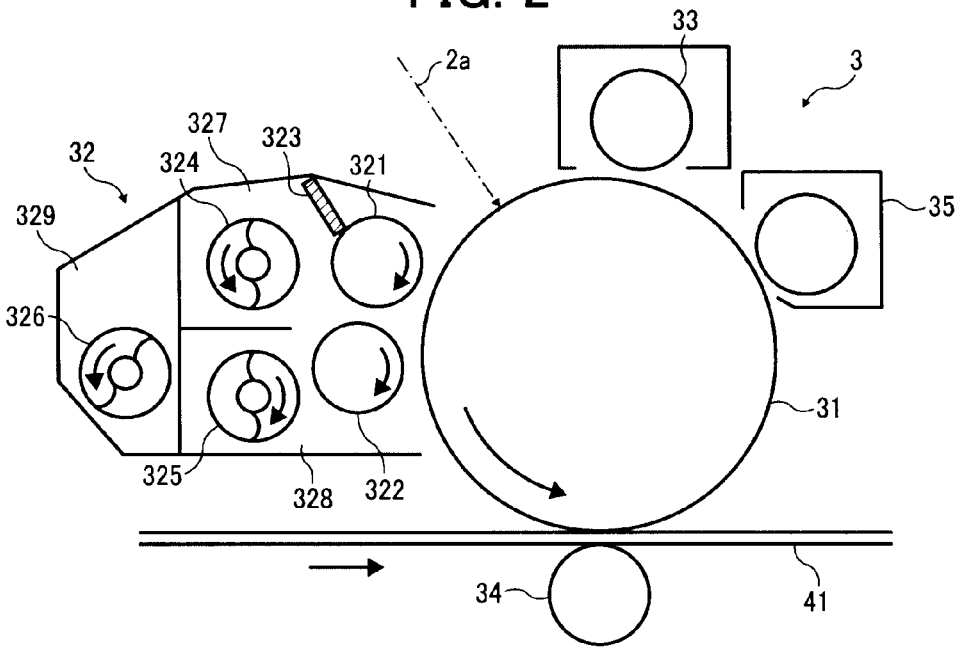
FIG. 2 illustrates a schematic configuration of image forming unit.

FIG. 2 illustrates a configuration of the image forming unit 3. Each of the image forming units 3 may have same configuration except colors of toner. Accordingly, reference characters for colors K, M, C, Y (black, magenta, cyan, yellow) may be omitted, as required.

As shown in FIG. 2, the image forming unit 3 may include the photoconductor drum 31, and process devices disposed around the photoconductor drum 31. For example, such process devices may be a charge unit 33, a development unit 32, a primary transfer roller 34, a cleaning unit 35 or the like.

The optical writing unit 2 emits a laser beam 2*a* onto the photoconductor drum 31. An image forming process including charging process, exposing process, development process, transfer process, and cleaning process can be conducted on the photoconductor drum 31 while the photoconductor drum 31 rotates. An image formed on the photoconductor drum 31 is transferred to the intermediate transfer belt 41 of the intermediate transfer unit 4. A configuration of development unit 32 will be described later with reference to FIG. 2.

In such configuration, a color image is formed as below. When the photoconductor drum 31 rotates in a direction shown by an arrow in FIG. 2, the surface of photoconductor drum 31 is uniformly charged by the charge unit 33 (charging process). Then, the charged surface of the photoconductor drum 31 is irradiated with the laser beam 2*a* emitted from the optical writing unit 2 to form an electrostatic latent image (exposing process). Then, the electrostatic latent image formed on the surface of photoconductor drum 31 is developed by the development unit 32 as a toner image (development process). Then, the surface of photoconductor drum 31 comes to a transfer position set between the intermediate transfer belt 41 and the primary transfer roller 34, at which the developed toner image on the photoconductor drum 31 is transferred to the intermediate transfer belt 41 (primary transfer process). Then, the surface of the photoconductor drum 31 is cleaned by the cleaning unit 35 to remove and recover not-transferred toner from the surface of the photoconductor drum 31 (cleaning process). Then, the surface of the photoconductor drum 31 is de-charged by a de-charging unit. With such processes, the image forming process on the photoconductor drum 31 is completed.

Such image forming processes are conducted for each color of toner black, magenta, cyan, yellow in the image forming unit 3. The toner images formed on the photoconductor drums 31K, 31M, 31C, and 31Y by the development process are sequentially transferred on the intermediate transfer belt 41 of the intermediate transfer unit 4, by which a full-color image composed of color toner images is formed on the intermediate transfer belt 41.

The color toner image formed on the intermediate transfer belt 41 comes to a position facing the secondary transfer roller 6 as the intermediate transfer belt 41 rotates. A secondary transfer position (or nip) is formed between the secondary transfer roller 6 and the counter roller 61 via the intermediate transfer belt 41. The color toner image formed on the intermediate transfer belt 41 is transferred to the recording sheet P at the secondary transfer nip when the recording sheet P is transported to the secondary transfer nip.

The recording sheet P is transported from the sheet feed tray 51, disposed at one side of the image forming apparatus 1, to the secondary transfer nip along the sheet transportation route 5 via the registration roller 54. The sheet feed tray 51 may store a number of sheets as recording sheet P. As the sheet feed roller 53 is driven in a clockwise direction, the top sheet of recording sheet P is transported to the registration roller 54. The recording sheet P stored in the sheet feed unit 55 can be also transported to the registration roller 54 using a sheet feed roller.

The recording sheet P transported to the registration roller 54 is temporary stopped at a roller nip of the registration roller 54 by stopping rotation of the registration roller 54. Then, the registration roller 54 is rotated again to transport the recording sheet P to the secondary transfer nip when the color toner image on the intermediate transfer belt 41 comes to the secondary transfer nip. With such process, the color toner image is transferred onto the recording sheet P.

The recording sheet P having the color toner image is transported to the fixing unit 7 through the sheet transportation route 5. The fixing unit 7 fixes the color toner image on the recording sheet P by applying heat and pressure using the fixing belt and pressure roller. Then, the recording sheet P is transported to the sheet ejection tray 52 through the sheet transportation route 5.

A double-face recording may be conducted as below. After the fixing unit 7 fixes the color toner image on one face of the recording sheet P, the recording sheet P is transported to the position 5*a* of the sheet transportation route 5, at which the recording sheet P is transported to the sheet reversing transportation route 56 by switching the switch claw to the sheet reversing transportation route 56. When the recording sheet P passes the reversing position 56*a* of the sheet reversing transportation route 56 and enters the reversing portion 561 by activating another switch claw, and is switchbacked. Then, the recording sheet P is transported to the position 5*b*. With such configuration, faces of the recording sheet P can be inverted, and a back face is fed to the registration roller 54 as a recording face. Then, another color toner image is transferred on the back face of the recording sheet P from the intermediate transfer belt 41, by which the double-face recording is completed. With such processes, an image forming process can be conducted in the image forming apparatus 1.

Figure 3:
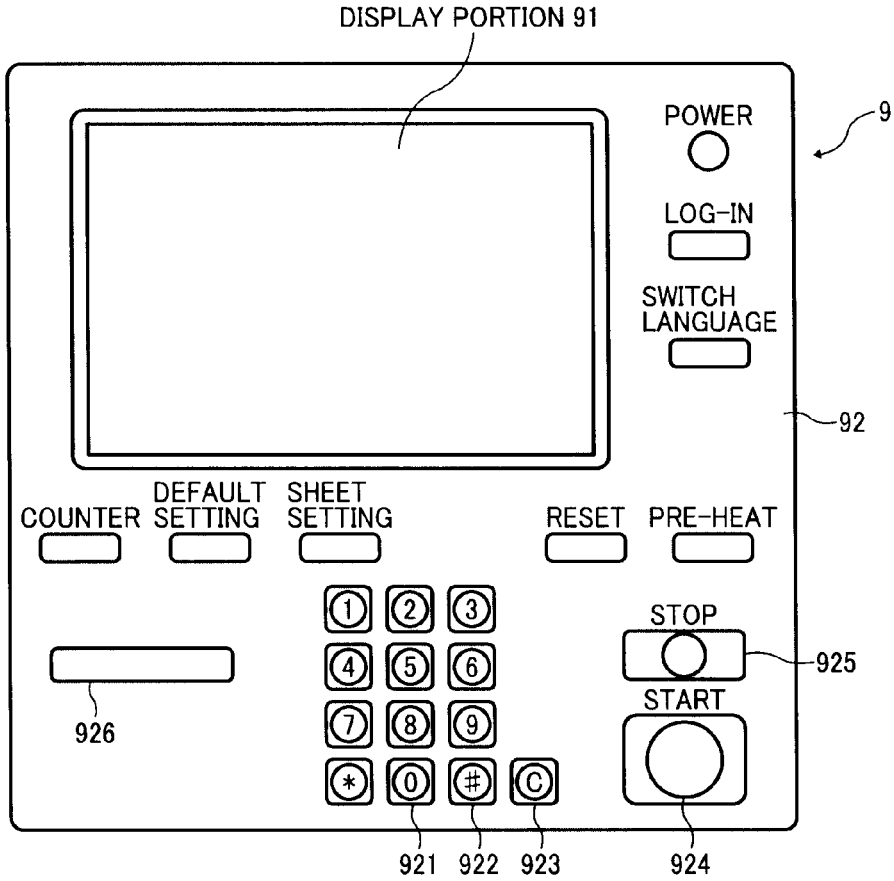
FIG. 3 illustrates an operation unit according to an example embodiment.

A description is now given to the operation unit 9 with reference to FIG. 3. FIG. 3 illustrates the operation unit 9 disposed at an upper side of the image forming apparatus 1. The operation unit 9 includes a display portion 91 and an operation key unit 92, for example. The display portion 91 and the operation key unit 92 may be used to check status of the image forming apparatus 1, user operation status, image forming condition, or change of such operation status and image forming condition.

The display portion 91 may include a display screen (e.g., touch panel), which may include buttons displayed on the display screen, for example. When one button is touched, information corresponded to the touched button can be selected and input in the image forming apparatus 1.

The operation key unit 92 may include function keys such as for example numeric keys 921, an enter key 922, a cancel key 923, a start key 924, a stop key 925, and an application calling key 926. The numeric keys 921 is used to set output condition and output sheet number; the enter key 922 is used to enter input information; the cancel key 923 is used to cancel the input information; the start key 924 is pressed to start a print operation; the stop key 925 is pressed to stop or interrupt the print operation; and the application calling key 926 is pressed to call functions operable in the image forming apparatus 1.

A description is given to the development unit 32 with reference to FIG. 2. The development unit 32 includes a first development roller 321, a second development roller 322, a doctor blade 323, transport screws 324 to 326 (324,325,326), a first developer transport route 327, a second developer transport route 328, and a third developer transport route 329. The first developer transport route 327, the second developer transport route 328, and the third developer transport route 329 may be separated each other by providing a wall therebetween.

The transport screws 324 to 326 are respectively disposed in the developer transport routes 327 to 329. The transport screws 324 to 326 may be composed of a shaft and a helical screw formed on the shaft. As the shaft of transport screw rotates, developer can be moved in the developer transport route along the axial direction of the shaft, by which developer in the development unit 32 can be circulated in an axial direction of development roller while the developer is agitated and mixed. The first development roller 321 and the second development roller 322 face the photoconductor drum 31, and the second development roller 322 is disposed under the first development roller 321. The doctor blade 323 is disposed over the first development roller 321 to regulate thickness of developer supplied on the first development roller 321.

The first developer transport route 327 may be set at a backward position of the first development roller 321 when viewed from the photoconductor drum 31. The second developer transport route 328 may be set at a backward position of the second development roller 322 when viewed from the photoconductor drum 31, and the second developer transport route 328 is set under the first developer transport route 327. The third developer transport route 329 may be set at a backward position of the first developer transport route 327 and the second developer transport route 328 when viewed from the photoconductor drum 31.

The developer transport routes 327 to 329 and the shafts of first and second development rollers 321 and 322 are arranged in parallel when viewed from the upper side. Further, the first developer transport route 327 and the second developer transport route 328 are set in a horizontal direction.

The first transport screw 324, disposed in the first developer transport route 327, rotates in a given direction to transport developer in a given direction in a horizontal direction, by which developer is supplied onto the first development roller 321. The second transport screw 325, disposed in the second developer transport route 328, rotates in a given direction to recover developer falling from the second development roller 322 and to transport the recovered developer in a given direction in a horizontal direction as similar to the first transport screw 324.

As shown in FIG. 2, the transport screws 324 to 326 may rotate in directions shown by arrows. Although the transport screws 324 and 325 may rotate in different directions, developer can be transported in a same direction because the transport screws 324 and 325 employ different configurations.

The third developer transport route 329 is disposed to communicate the downstream end side of developer transportation direction of the second developer transport route 328 and the upstream end side of developer transportation direction of the first developer transport route 327. Specifically, the third developer transport route 329 is formed in a slanted manner from upper to lower direction.

Specifically, the third developer transport route 329 is formed as a straight route, slanted with respect to a horizontal direction, to connect the downstream end side of developer transportation direction of the second developer transport route 328 and the upstream end side of developer transportation direction of the first developer transport route 327. In the second developer transport route 328, the second transport screw 325 transports developer to the downstream side of developer transportation direction in the second developer transport route 328. In the first developer transport route 327, the first transport screw 324 transports developer from the upstream side of developer transportation direction in the first developer transport route 327. As such, the third transport screw 326 transports developer in a slanted direction with respect to a horizontal direction.

Accordingly, developer transported by the second transport screw 325 is transferred to the third transport screw 326 in the third developer transport route 329, and then the third transport screw 326 transports developer to the upstream side of developer transportation direction of the first transport screw 324 to supply developer into the first developer transport route 327.

Further, the second developer transport route 328 and the third developer transport route 329 are communicated each other via a first intermediary section (not shown) disposed on a wall, and the third developer transport route 329 and the first developer transport route 327 are communicated each other via a second intermediary section (not shown) disposed on a wall.

Further, the downstream end side of developer transportation direction of the first developer transport route 327 and the upstream end side of developer transportation direction of the third developer transport route 329 are connected by a descending route disposed via the wall.

As such, a developer circulation route is configured by one transport route and another transport route: the one transport route extends from the second developer transport route 328, through the third developer transport route 329, to the first developer transport route 327; the another transport route extends from the first developer transport route 327, through the descending route, to the third developer transport route 329.

In such configuration, each of the transport screws 324-326 may be activated when the image forming apparatus conducts an initialization process when a power source is set to ON, or when an image forming operation is conducted. When the transport screws 324-326 are activated, recovered developer is transported in the second developer transport route 328, and then transported to the third developer transport route 329 from the downstream side of the second developer transport route 328, and further transported to the upstream side of the first developer transport route 327. Developer transported in the first developer transport route 327 is supplied onto the first development roller 321. Then, developer is transferred from the downstream side of the first developer transport route 327 to the upstream side of the third developer transport route 329 through the descending route. Then, developer is transported in the third developer transport route 329, and transported to the upstream side of first developer transport route 327. As such, developer can be circulated in the development unit 32.

Figure 4:
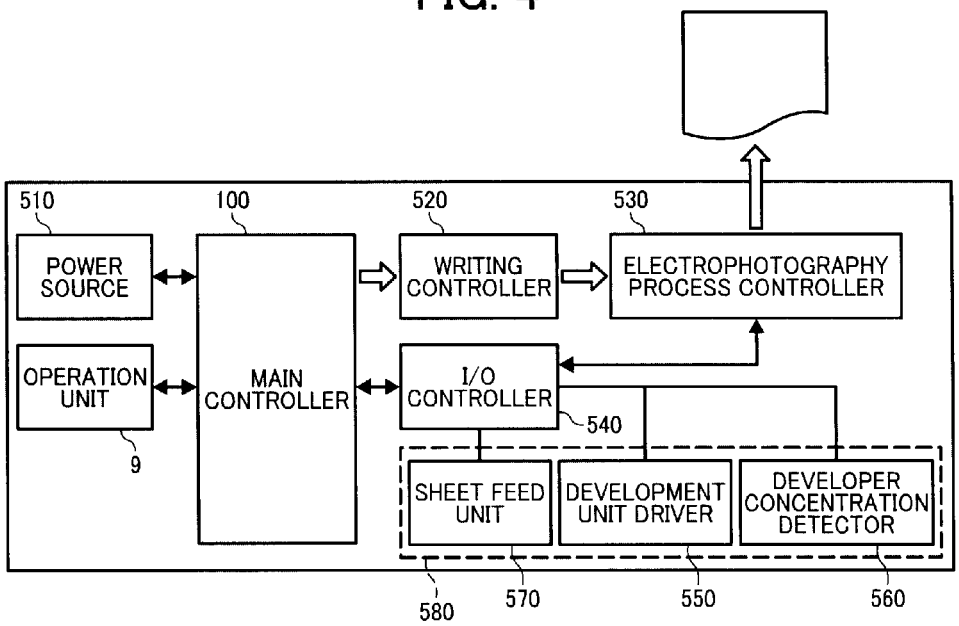
FIG. 4 shows a block diagram of image forming apparatus of FIG. 1.

A description is given to a control system of image forming apparatus 1 with reference to FIG. 4. FIG. 4 shows a block diagram of control system of the image forming apparatus 1. The control system may include a main controller 100, a power source 510, the operation unit 9, a writing controller 520, an electrophotography process controller 530, an I/O (input/output) controller 540, for example. The main controller 100 controls the image forming apparatus 1 as a whole. The writing controller 520 controls writing process using a laser beam based on input/output image information for the image forming apparatus 1. The electrophotography process controller 530 controls an image forming process. The I/O controller 540 controls electrical devices such as motor and sensor. The main controller 100 may store programs and data, wherein such programs is used to control the image forming apparatus 1 and data required for running programs.

The I/O controller 540 is connected to a controlled unit 580 in the image forming apparatus 1 to control the controlled unit 580. The controlled unit 580 may be a sheet feed unit 570, a development unit driver 550, and a developer concentration detector 560, for example. The sheet feed unit 570 controls the sheet feed roller 53 and the registration roller 54. The development unit driver 550 controls a drive motor 200. The developer concentration detector 560 detects concentration of developer using a magnetic sensor 240. The drive motor 200 and the magnetic sensor 240 will be described later.

Further, the I/O controller 540 may be separately disposed to each one of the controllers (e.g., writing controller 520, electrophotography process controller 570) to control each one of the controllers. Further, the I/O controller 540 may be included in the main controller 100 as one of units configuring the main controller 100.

Figure 5:
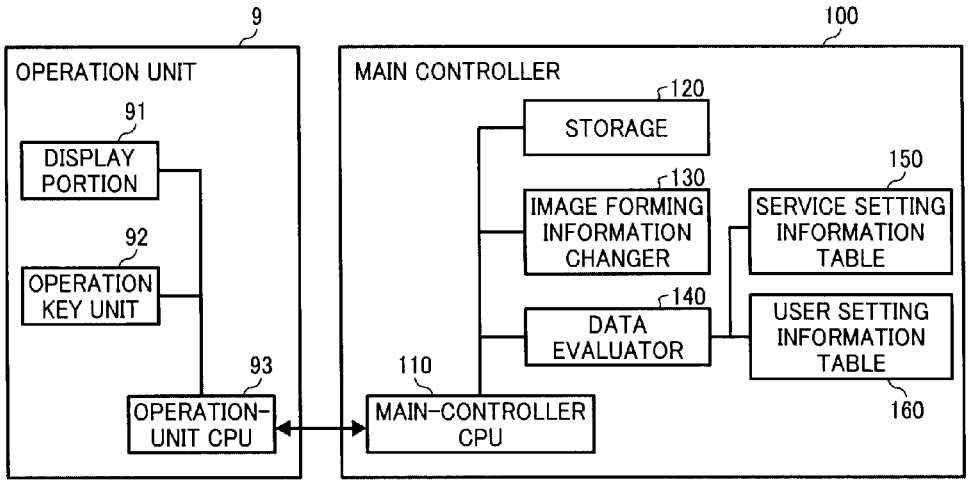
FIG. 5 shows a block diagram of control units for the image forming apparatus of FIG. 1.

FIG. 5 shows the operation unit 9 and the main controller 100 in detail. As shown in FIG. 5, the operation unit 9 may include the display portion 91, the operation key unit 92, and an operation-unit CPU 93. The main controller 100 may include a main-controller CPU 110, a storage 120, an image forming information changer 130, a data evaluator 140, a user setting information table 160, and a service setting information table 150, for example.

The operation-unit CPU 93 controls information displayed on the display portion 91 and information input by the operation key unit 92. The operation-unit CPU 93 is connected to the main-controller CPU 110 via a communication line so that such information can be controlled by an interactive communication between the operation-unit CPU 93 and the main-controller CPU 110.

The storage 120 stores image forming operation information. The storage 120 may be a non-volatile memory such as non-volatile random access memory (NV-RAM), which can store image forming operation information of the image forming apparatus 1. The image forming operation information may include default value and setting value of image forming condition used for image forming operation, but not limited thereto. Such image forming operation information is used to set conditions for the image forming apparatus 1. The storage 120 is connected to the image forming information changer 130. When a user or a service engineer inputs image forming information, such input image forming information may be stored in the storage 120 via the image forming information changer 130.

The image forming information changer 130 is connected to the data evaluator 140, and the data evaluator 140 is connected to the user setting information table 160 and the service setting information table 150. When a user conducts a maintenance work, a user maintenance mode is applied using the user setting information table 160. When a service engineer conducts a maintenance work, a service program mode is applied using the service setting information table 150.

When some image forming information is input, the data evaluator 140 evaluates whether such input information is for the user maintenance mode or the service program mode, and determines which one of the setting information table 150 and 160 is used. The user setting information table 160 and the service setting information table 150 may be stored and managed in the storage 120 of the main controller 100.

Further, the storage 120 may store a developer maintenance counter value for each one of the development units 32 and reference value for determining replacement timing of developer, wherein such reference value may be the number of printed sheets set as a number for determining replacement timing of developer. The developer maintenance counter value is counted for one value when the development unit 32 is used for one printing operation, for example.

A description is now given to image forming parameter setting, which is conductable by a user as a maintenance work. Such image forming parameter setting may be conducted using an image adjustment mode, for example.

The service program mode provides an given adjustment range, which can set operating parameters for achieving higher quality of image forming for the image forming apparatus 1 under various usage environment. However, the adjustment range of the service program mode may require extensive technical knowledge and skills for image forming process, which can be handled only by a trained service engineer. If, by any chance, a untrained user changes image forming conditions by using the adjustment range set for the service program mode, trouble or problem may occur to the image forming apparatus 1. For example, the image forming apparatus 1 may produce image having degraded image quality, or the image forming apparatus 1 cannot be activated at worst. To avoid risk such as negative effect to the image forming apparatus 1, an adjustment range adjustable by a user is set limited or narrower compared to the adjustment range adjustable by a service engineer.

Such adjustment range is defined in the service setting information table 150 and the user setting information table 160 of the main controller 100 shown in FIG. 5. A description is now given to the service setting information table 150 and the user setting information table 160 with reference to FIG. 6. As shown in FIG. 6A, the service setting information table 150 is registered with image forming information used for condition adjustment.

Such image forming information of the service setting information table 150 may be classified into a first classification 151 and a second classification 152 to identify each of information items. The information items may be referred to as "selections." Practically, the first classification 151 may be referred as large classification, and the second classification 152 may be referred as small classification. Each item of the second classification 152 may include a default value 153, a minimum value 154, a maximum value 155, and a step value 156, for example. The default value 153 may be set when an image forming information is defaulted. The minimum value 154 is a value that can be set as smallest value. The maximum value 155 is a value that can be set as greatest value. The step value 156 is a smallest step value, wherein value of information can be changed step-wisely from one value to anther value with an increment or decrement value corresponding to such step value 156.

Further, the user setting information table 160 may be registered with image forming information item, which may correspond to all or part of image forming information item of the service setting information table 150. A user can use such image forming information item registered in the user setting information table 160 for adjustment operation. The user setting information table 160 may have a similar or common data/information configuration of the service setting information table 150. As shown in FIG. 6B, the image forming information may be classified into a first classification 161 and a second classification 162 to identify each of information. The first classification 161 may be referred as large classification, and the second classification 162 may be referred as small classification.

Each item of the second classification 162 may include a default value 163, a minimum value 164, a maximum value 165, and a step value 166, for example. The default value 163 may be set when an image forming information is defaulted. The minimum value 164 is a value that can be set as smallest value. The maximum value 165 is a value that can be set as greatest value. The step value 166 is a smallest change-able value, wherein value of information can be changed step-wisely from one value to anther value with an increment or decrement value corresponding to such step value 166.

As described later with reference to FIG. 9, such items classified under a given standard can be displayed as image forming information item on an image forming information list window 191 (see FIG. 9).

In an example embodiment, the user setting information table 160 and the service setting information table 150 may register same items for the second classification (small classification). However, the value of minimum value and maximum value are differentiated between the user setting information table 160 and the service setting information table 150. Specifically, the value of minimum value 164 is set greater than the value of minimum value 154, and the value of maximum value 165 is set smaller than the value of maximum value 155 as shown in FIGS. 6A and 6B. As such, the minimum value registered in the user setting information table 160 is set greater than the minimum value registered in the service setting information table 150, and the maximum value registered in the user setting information table 160 is set smaller than the maximum value registered in the service setting information table 150. As such, the adjustment range for the user setting information table 160 is set smaller or narrower than the adjustment range for the service setting information table 150.

For example, as shown in FIG. 6, in case of item number 1710-1 (a combination of first classification 1710 and second classification 1), the minimum value 154 is −10.0 mm (minus 10.0 mm) and the maximum value 155 is 10.0 mm for the service setting information table 150, and the minimum value 164 is −5.0 mm and the maximum value 165 is 5.0 mm for the user setting information table 160. As such, maintenance work for the image forming apparatus can be categorized into a service-maintenance work conductable by a service engineer within service-operation content, and a user-maintenance work conductable by a user within user-allowed-operation content. The user-allowed-operation content is differentiated from the service-operation content. The user-allowed-operation content, differentiated from the service-operation content, may be referred to as a user-adjustment range for the user-maintenance work, and the service-operation content may be referred to as a service-adjustment range for the service-maintenance work.

In an example embodiment, the item number 1710-1 is corresponded to "sheet transportation registration adjustment," which is an image position adjustment in a sub-scanning direction when an image is formed on a front face of the recording sheet P. The "sheet transportation registration adjustment" indicated by the item number 1710-1 may be common to the upper and lower trays of the sheet feed tray 51 (set as the upper tray and lower trays in body), and other trays. Accordingly, one type of second classification (small classification) is defined.

The item numbers 1711-1 to 1711-10 are corresponded to "image position adjustment in a sub-scanning direction" when an image is formed on a back face of the recording sheet P. Such "image position adjustment in a sub-scanning direction" may be set for each one of trays for condition adjustment. For example, in this case, the second classification (small classification) includes a plurality of conditions as follows.

The item numbers 1711-1 and 1711-2 are set for the upper and the lower tray of the sheet feed tray 51; 1711-1 is corresponded to the upper tray of the sheet feed tray 51 (set as upper tray in body); 1711-2 is corresponded to the lower tray of the sheet feed tray 51 (set as lower tray in body).

The item numbers 1711-3 and 1711-10 are be set for optional trays; 1711-3 is corresponded to a upper tray of A4 large capacity tray (A4 LCT upper tray); 1711-4 is corresponded to a middle tray of A4 large capacity tray (A4 LCT middle tray); 1711-5 is corresponded to a lower tray of A4 large capacity tray (A4 LCT lower tray); 1711-6 is corresponded to a manual feed tray; 1711-7 is corresponded to a upper tray of A3 large capacity tray of first unit (A3 LCT (1) upper tray); 1711-8 is corresponded to a lower tray of A3 large capacity tray of first unit (A3 LCT (1) lower tray); 1711-9 is corresponded to a upper tray of A3 large capacity tray of second unit (A3 LCT (2) upper tray);

1711-10 is corresponded to a lower tray of A3 large capacity tray of second unit (A3 LCT (2) lower tray).

The above-described settings are applied to items in view of following reasons. In an image forming process, an image is formed on a surface of recording sheet while an image forming position on a surface of recording sheet is adjusted. The recording sheet to be fed for image forming process is stored in trays for sometime before the recording sheet is used for image forming process, or the recording sheet unpacked from a sheet package may be used for image forming process immediately. Although the recording sheet stored in trays for sometime may absorb moisture, the recording sheet stored or set in trays can be used similar manner when an image forming process is to be conducted for the first time on a front face of recording sheet. Accordingly, image forming process can be similarly conducted for various types of recording sheet fed from any trays, by which the image forming position on the recording sheet may not fluctuate so much among different sheets. It should be noted that such image position adjustment in a sub-scanning direction may not be required for recording sheets newly set in an image forming apparatus, in general, but some sheets may require such adjustment depending on sheet material types.

On the contrary, when an image is to be formed on a back face of recording sheet for a double-face printing, one image is already formed and fixed on the front face of recording sheet. Accordingly, such recording sheet P may have been shrinked for some amount due to a front-face printing process, and thereby the size of the recording sheet P may change or fluctuate. Such size fluctuation of sheet may vary depending on sheet size of the recording sheet P. Accordingly, to match or align the image position in the sub-scanning direction on the front and back faces of recording sheet with higher precision, a positional adjustment operation may be required. Accordingly, in an example embodiment, different item numbers are assigned for each of trays to set corresponding settings for each one of trays so that a fine adjustment can be conducted for various types of sheet, which may be differentiated in terms of sheet size, sheet orientation, or the like.

Figure 7:
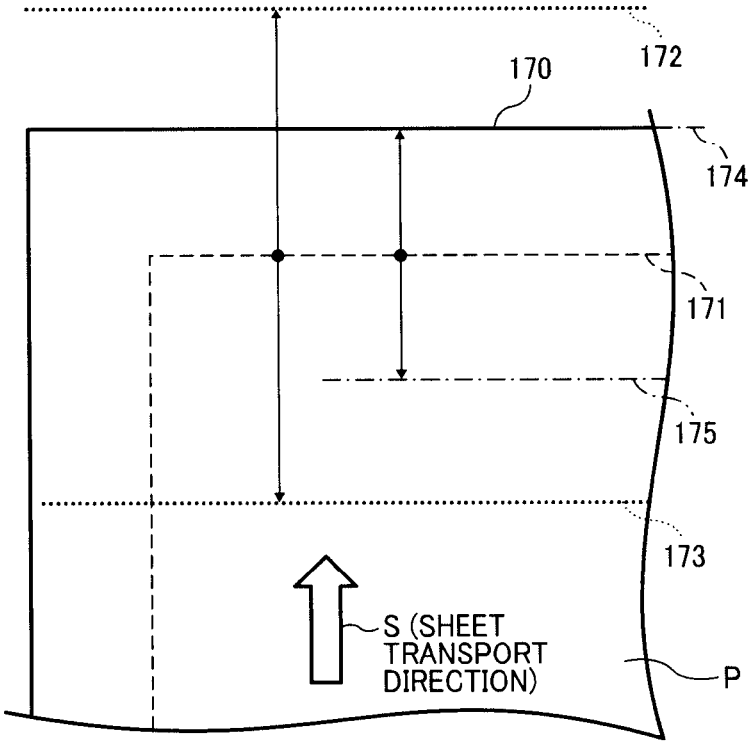
FIG. 7 illustrates an adjustment range of image forming start position.

A description is given to difference of adjustment range set for the service setting information table 150 and the user setting information table 160 with reference to FIG. 7, which is used to describe a sheet transportation registration adjustment.

FIG. 7 shows a record-starting position of image on the recording sheet P and an adjustment range of record-starting position. The record-starting position may be referred to an image registration position of on the recording sheet P in the sub-scanning direction.

In FIG. 7, the recording sheet P is transported in a direction shown by an arrow S (sheet transport direction), and an image recording-start position 171 of the recording sheet P in the sub-scanning direction is set at given position, which is distanced from a leading edge 170 of the recording sheet P. For example, the image recording-start position 171 may be distanced from the leading edge 170 for about 5 mm.

The image recording-start position 171 may be used a standard reference position to start an image forming for one image to be formed on one face of the recording sheet. The standard reference position is set as the default value 153 and the default value 163, defined in the service setting information table 150 and the user setting information table 160, respectively.

A position set by the default value 153 or the default value 163 is used as standard reference position. The minimum value 154 or 164 is used as an earliest image-record-starting position, and the maximum value 155 or 165 is used as a latest image-record-starting position. A value between the minimum value 154 (or 164) and the default value or 153 (or 163) may be referred to as minus-value, and a value between the default value or 153 (or 163) and the maximum value 155 (or 165) may be referred to as plus-value. Accordingly, a range from the minimum value 154 (or 164) to the maximum value 155 (or 165) may be referred to as an adjustment range.

Typically, the recording sheet P may be plain paper, recycled paper, and other various types of paper. Accordingly, a number of papers having various sheet types and sheet thickness may be used. When sheet type or sheet thickness is changed, sheet transportation performance may fluctuate in the image forming apparatus 1, and thereby same sheet transportation performance quality may not be attained for various types of paper.

Specifically, due to slipping of paper during sheet transportation, different warping level of sheets or the like, a position of the leading edge 170 of recording sheet P may fluctuate for about several millimeters for various types of sheet. As a result, the image recording-start position 171 on the recording sheet P may deviate from a desired position.

In view of such fluctuation of sheet transportation performance, the image forming apparatus 1 may be provided with a sheet-registration adjustment function, which can adjust the image recording-start position 171 depending on sheet condition. Such sheet-registration adjustment function can reduce fluctuation of sheet transportation performance, by which a good level of image quality can be maintained.

In general, change of image forming information may degrade image quality, and at worst, may degrade machine-operating quality of image forming apparatus. Accordingly, a trained service engineer or technical staff may need to conduct such condition adjustment. As for the sheet-registration adjustment function, a service engineer applies the service program mode using the service setting information table 150 to attain higher image quality under various environmental conditions.

An example of such service program mode using the service setting information table 150 is explained. For example, the image recording-start position 171 used as a standard reference position is set at a given position on the recording sheet P distanced from the leading edge 170 of the recording sheet P (e.g., 5 mm from the leading edge 170). With respect to the image recording-start position 171, the earliest image-record-starting position (minus-value side) is set as a minimum value of −10.0 mm (a position 172 in FIG. 7), and the latest image-record-starting position (plus-value side) is set as a maximum value of +10.0 mm (a position 173 in FIG. 7). Accordingly, an adjustment range of 20 mm can be set. Under such setting configuration, an image forming operation can be started at a given timing earlier than a timing that the leading edge 170 of recording sheet P comes to an image forming position because the minimum value of −10.0 mm is outside the leading edge 170 of recording sheet P. Accordingly, if a setting value is adjusted in a certain value in the minus-value side, an image-forming position may become an outside the leading edge of the recording sheet P, and if a setting value is adjusted in a certain value in the plus-value side to delay an image-forming timing, a portion of image may not be formed on the recording sheet P because such portion may be outside the rear edge of the recording sheet P Except some special situations, a sheet-position adjustment for various types of sheets can be conducted within a relatively narrower range around the image recording-start position 171 (standard reference position set by a default value). In such a case, a user can effectively conduct a sheet-registration adjustment. In view of such situation that a user can conduct a sheet-registration adjustment, the user maintenance mode using the user setting information table 160 may be applied for the image adjustment mode.

For example, the image recording-start position 171 used as a standard reference position is set at a given position on the recording sheet P distanced from the leading edge 170 of the recording sheet P (e.g., 5 mm from the leading edge 170). With respect to the image recording-start position 171, the earliest image-record-starting position (minus-value side) is set as a minimum value of −5.0 mm (a position 177 in FIG. 7), and the latest image-record-starting position (plus-value side) is set as a maximum value of +5.0 mm (a position 175 in FIG. 7). Accordingly, an adjustment range of 10 mm can be set for the user maintenance mode, which may be one half of the service program mode, for example.

Under such adjustment range set for the user-maintenance work, a user cannot change the image-record-starting position beyond 5.0 mm of the image recording-start position 171 (default value). If sheet transportation fluctuation of the recording sheet P does not exceed 5 mm, an image may not be formed at an area outside the recording sheet P as long as an adjustment is conducted in a correct direction (plus-value or minus-value side)

Accordingly, image quality degradation such as lack of image information and tainted back face, or machine-operating quality degradation over time can be prevented. With such a configuration, a user can conduct an image adjustment while attaining a higher image quality, and further, a cost loss (e.g., business opportunity loss) of user caused by an image quality degradation or machine-operating quality degradation can be prevented.

Figure 8:
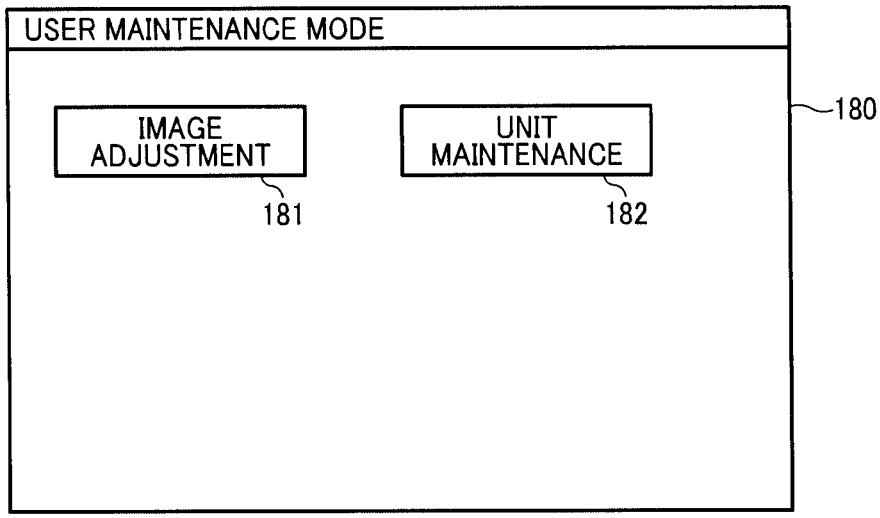
FIG. 8 shows an user maintenance screen for image adjustment mode.
Figure 9:
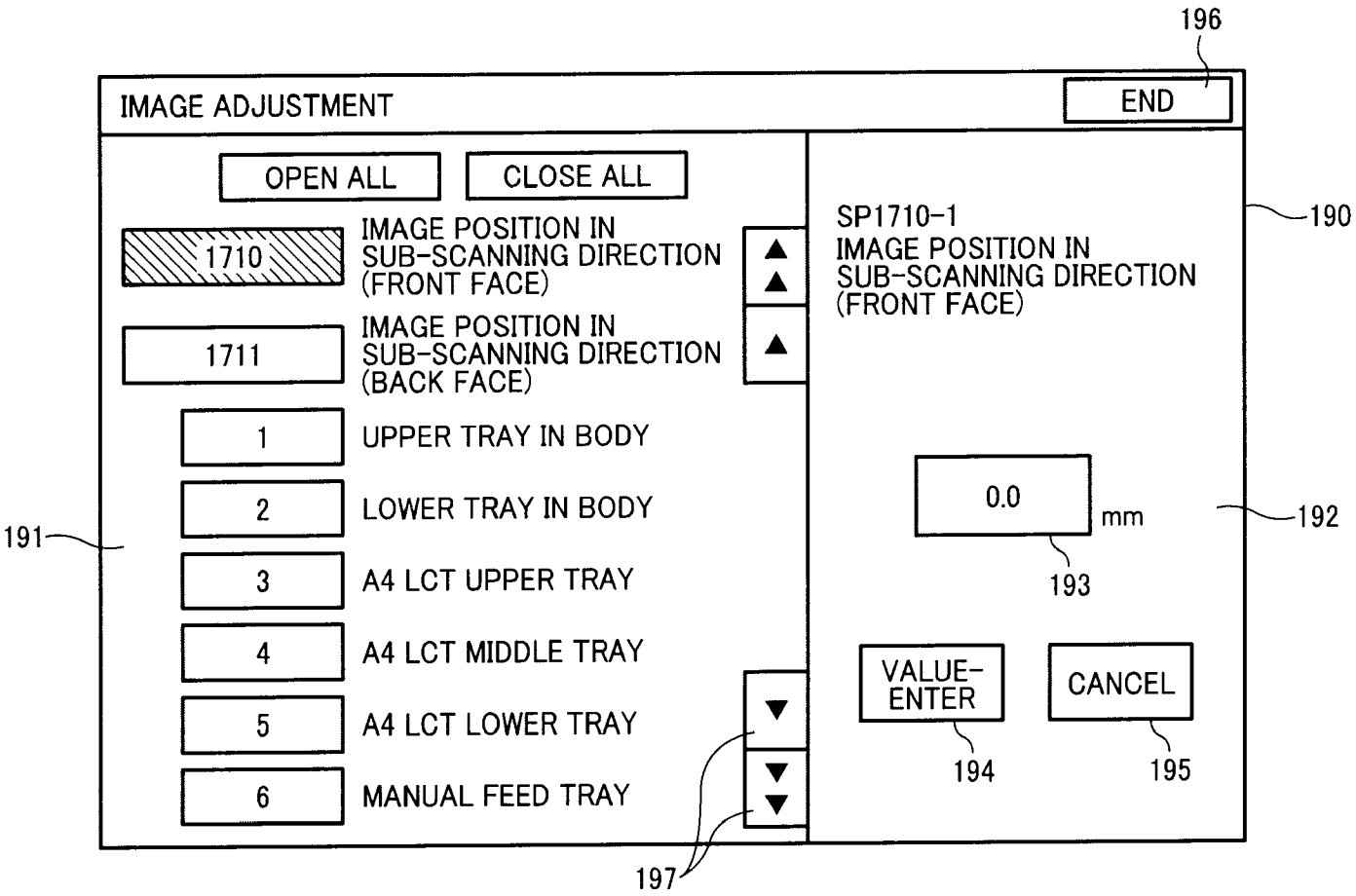
FIG. 9 shows an image adjustment mode screen for image adjustment mode.

A description is now given to an operation unit and its operation procedure using an image adjustment mode of the image forming apparatus 1 with reference to FIG. 8 and FIG. 9. The operation unit may include an operation panel (e.g., touch panel), for example. The operation unit may be referred to as an operation screen unit, which may include a user-specific operation screen, with which the user-maintenance work is conductable for adjusting the maintenance function within the user-allowed-operation content. The user-specific operation screen displays the user-allowed-operation content, differentiated from the service-operation content.

A user may recognize a need of image adjustment when some events occur such as change of sheet type of recording sheet P, and then conduct the image adjustment. Such image adjustment may be conducted as below.

The user presses the application calling key 926 disposed on the operation key unit 92 of the operation unit 9. Then, the user maintenance mode screen 180 is displayed on the display portion 91 of the operation unit 9 as shown in FIG. 8. The user maintenance mode screen 180 displays an image adjustment button 181 and a unit maintenance button 182. The image adjustment button 181 is selected when to conduct image adjustment related to a mechanical adjustment such as adjusting image transfer position on a recording sheet, for example. The unit maintenance button 182 is selected when to conduct a unit maintenance work such as replacement of developer, for example.

The user can conduct the image adjustment by selecting the image adjustment button 181 on the display portion 91. When the image adjustment button 181 is selected, an image adjustment mode screen 190 is displayed on the display portion 91 as shown in FIG. 9.

As shown in FIG. 9, the image adjustment mode screen 190 includes an image forming information list window 191 and an adjusting-information display window 192. The image forming information list window 191 displays a list of image forming information items (or selections), which can be adjusted by a user. The adjusting-information display window 192 is used to display information of item, selected from the image forming information list window 191, and to change information of items (e.g., parameters), selected from the image forming information list window 191.

The image forming information list window 191 displays each item of image forming condition, usable for image adjustment, with a button. The user can select items of image forming condition to be adjusted by selecting the button. The image forming information list window 191 may display items of the first classification 161 and the second classification 162 shown in FIG. 6B as image forming information.

The adjusting-information display window 192 displays a value window 193, a value-enter button 194, and a cancel button 195, for example. As shown in FIG. 9, the image adjustment mode screen 190 includes an end button 196 and a scroll button 197. The end button 196 is used to end the image adjustment mode.

In the image adjustment mode screen 190, the user can select items to be used for image adjustment from items of image forming information displayed on the image forming information list window 191. Such item selection can be conducted by selecting a corresponding button on the image forming information list window 191. When one item of image forming information is selected, the selected item is displayed on the adjusting-information display window 192, and the user can confirm an actual value set for the selected item by referring the value window 193.

When the user wants to change a setting value, set for image forming information of the selected item, the user can input new setting value by using the numeric keys 921 disposed on the operation key unit 92 of the operation unit 9. The input new setting value can be displayed in the value window 193.

The input new setting value can be set by selecting the value-enter button 194 displayed on the adjusting-information display window 192 or by pressing the enter key 922 on the operation unit 9, for example. If the user wants to cancel the input new setting value and to re-display the presently-set setting value, the user selects the cancel button 195, or presses the cancel key 923 on the operation unit 9.

When the value-enter button 194 is selected or the enter key 922 is pressed, the main-controller CPU 110 determines whether the input setting value is within the adjustable range by using the data evaluator 140 and the user setting information table 160.

If the input setting value is out of the adjustable range, the input setting value is rounded to the maximum value or the minimum value by conducting a rounding process, and a rounded value is used as the input setting value. Such rounded value, which is a settable value, is stored in the storage 120 via the image forming information changer 130.

When the image adjustment process is completed, the end button 196 is selected to end the image adjustment mode. The image adjustment process using the image adjustment mode can be conducted with the above-described processes.

In case of the unit maintenance mode, which can be operated by a user for maintenance work of apparatus, an operation screen (e.g., screen on touch panel) that can be used by the user may be provided. Such operation screen, which may be referred to as the user-specific operation screen, can be displayed on the display portion on the operation unit 9 by selecting a specific function key disposed on the operation unit 9.

On the contrary, the service program mode can be accessed only by a service engineer but not by a general user. A program mode can be switched to the service program mode by pressing a plurality of operation keys on the operation key unit 92 of the operation unit 9 with a given sequence or combination, for example. With such process, image forming information can be changed by a service engineer using the service program.

Figure 10:
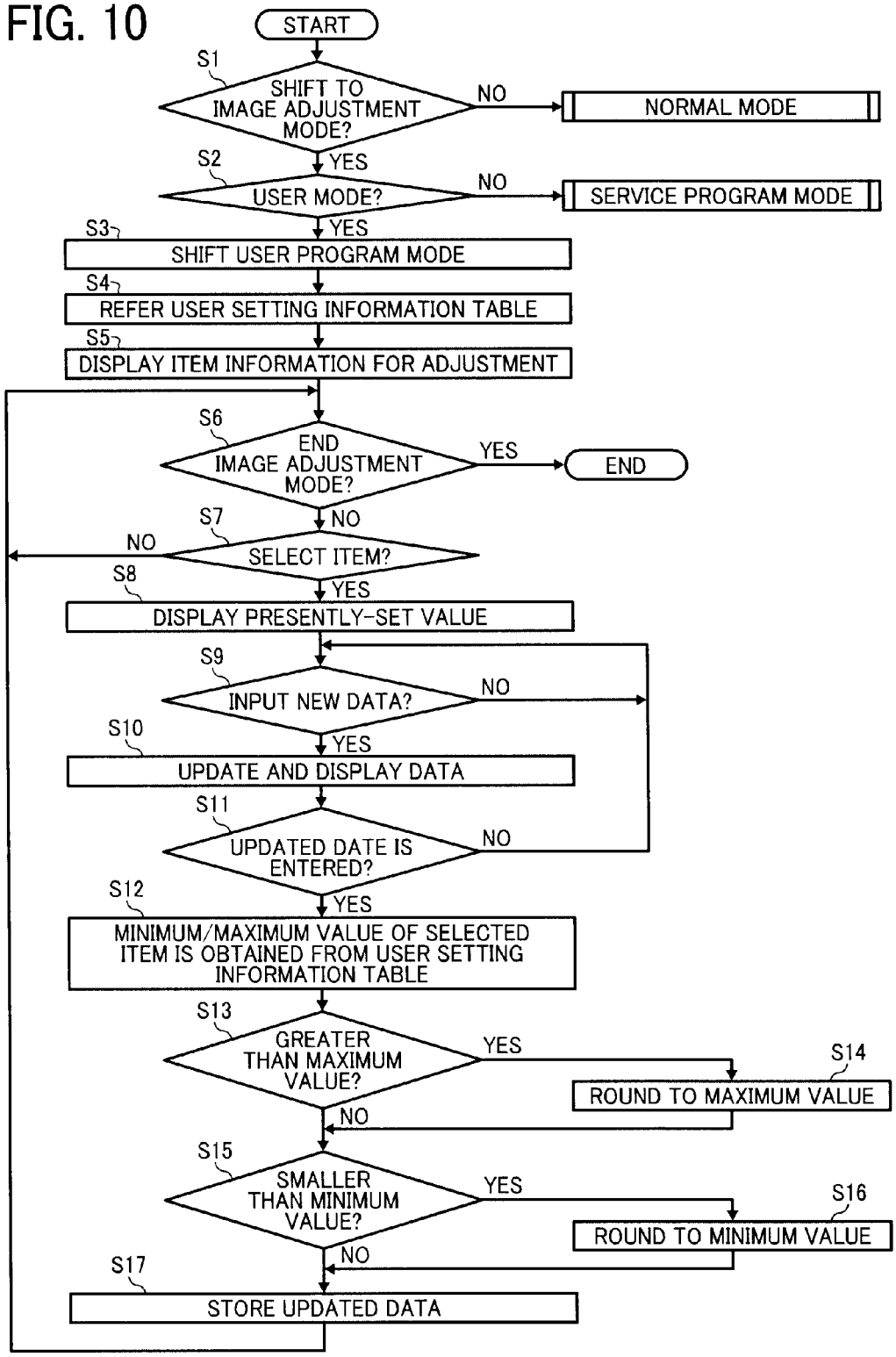
FIG. 10 shows a flowchart for process flow of image adjustment mode.

A description is now given to a process flow of the image adjustment mode in the user maintenance mode with reference to FIG. 10.

When the image forming apparatus 1 is activated by supplying a main power, and enters a stand-by condition, the image forming apparatus 1 may wait a given instruction such as an operation instruction from a user, a print request from a remotely-disposed terminal apparatus, or the like.

When the application calling key 926 disposed on the operation key unit 92 of the operation unit 9 is pressed, the user maintenance mode screen 180 is displayed (e.g., screen of FIG. 8) on the display portion 91 of the operation unit 9.

When the image adjustment button 181 is selected on the user maintenance mode screen 180, the program mode is shifted to the image adjustment mode (YES at step S1). If the program mode is determined as a user mode (YES at step S2), the program mode is shifted to the user program mode such as user maintenance mode (step S3).

If the image adjustment button 181 on the user maintenance mode screen 180 is not selected within a given time, it is determined that a shift to the image adjustment mode is not selected (NO at step S1), and returns to a normal mode. Further, if it is determined that the program mode is not the user mode (NO at step S2), the program mode shifts to the service program mode. After step S3, the CPU sets a memory address for a table used for referring the user setting information table 160, and refers to the user setting information table 160 (step S4).

When the user setting information table 160 is referred, the item list of image forming information, which is defined by combination patters of the first classification 161 and the second classification 162, is displayed on the display portion 91 of the operation unit 9. Specifically, as shown in FIG. 9, the item list of image forming information is displayed in the image forming information list window 191 of the image adjustment mode screen 190 (step S5). As such, item information to be used for condition adjustment is displayed.

The image adjustment mode screen 190 includes the end button 196 as described above. If the end button 196 is selected, the image adjustment mode screen 190 is closed and ended (Yes at step S6). If the end button 196 is not selected (No at step S6), it is checked whether one of items displayed on the image forming information list window 191 is selected (step S7). When the item displayed on the image forming information list window 191 is selected (Yes at step S7), a presently-set value set as image forming information for the selected item and stored in the storage 120 is read, and the presently-set value is displayed in the value window 193 of the adjusting-information display window 192 (step S8).

If the user inputs a new data using the numeric keys 921 of the operation unit 9 (YES at step S9), data displayed in the value window 193 is changed or updated to the input new data (step S10). If the value-enter button 194 is selected or the enter key 922 of the operation unit 9 is pressed (step S11), the input new data is entered as updated data. Then, the minimum value 164 and the maximum value 165 set for image forming information of the selected item is obtained from the user setting information table 160 (step S12).

If the input new data is greater than the maximum value 165 (YES at step S13), the input new data is rounded to the maximum value 165 by a rounding process (step S14). If the input new data is smaller than the minimum value 164 (Yes at step S15), the input new data is rounded to the minimum value 164 by a rounding process (step S16). Then, the finally-confirmed new or updated data is stored in the storage 120 via the image forming information changer 130 (step S17).

Such adjustment operation may be repeatedly conducted, as required. When such adjustment operation is completed, the end button 196 is selected (Yes at step S6) to close and end the image adjustment mode screen 190, and the screen returns to the user maintenance mode screen 180 (e.g., screen of FIG. 8). By conducting the above-described adjustment operation, given numeric value can be stored in the storage 120 and set as image forming condition of item, which may need adjustment of image forming condition.

FIG. 9 shows one example screen that the item number 1710-1, corresponding to the image position adjustment in a sub-scanning direction when an image is formed on a surface of the recording sheet P, is selected for condition adjustment. When a given numeric value is set by using the above-described adjustment operation using the screen shown in FIG. 9, the I/O controller 540 controls the sheet feed unit 570 based on the set numeric value so that a sheet-registration adjustment can be conducted by the registration roller 54. The image adjustment can be conducted as such.

In the above described process, the input new data receives a rounding process if the input new data is greater than the maximum value 165 or smaller than the minimum value 164. Specifically, the input new data greater than the maximum value 165 is rounded to the maximum value 165, and the input new data smaller than the minimum value 164 is rounded to the minimum value 164. Further, such rounding process may be conducted when a user input data. For example, if the user input numeric value greater than the maximum value 165 or smaller than the minimum value 164, such input numeric value can be rounded and then displayed in the value window 193 as the maximum value 165 or the minimum value 164. Further, the maximum value 165 and the minimum value 164 may be displayed on a display screen (e.g., adjusting-information display window 192) so that a user can recognize the adjustable range when inputting new numerical value.

Figure 11:
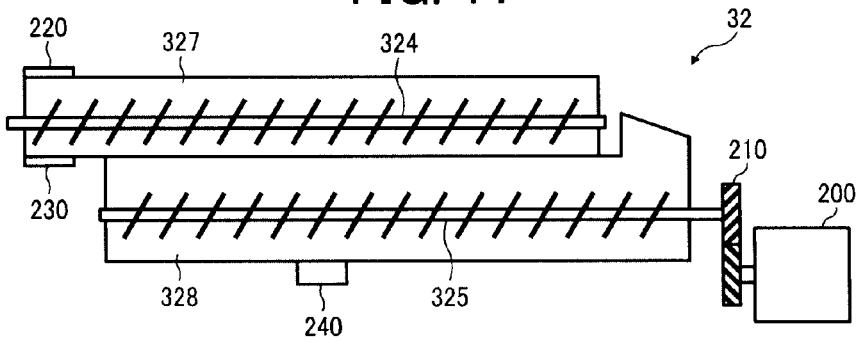
FIG. 11 illustrates a schematic configuration of a fist developer transport route and a second developer transport route in an axial direction in development unit.

A description is now given to a maintenance work such as replacement of developer conductable by a user with reference to FIG. 11. FIG. 11 illustrates a schematic configuration of the first developer transport route 327 and the second developer transport route 328 in the development unit 32 viewed from one side of the development unit 32.

As show in FIG. 11, the second transport screw 325 is connected to the drive motor 200 via a drive force transmission gear 210. The drive motor 200 is used to rotate a rotatable member configuring the development unit 32. The drive motor 200 drives the second transport screw 325 to rotate, and such rotary movement is transmitted from the second transport screw 325 to the first transport screw 324 via a transmission gear (not shown) and further to the third transport screw 326 (see FIG. 2).

As shown in FIG. 11, the first developer transport route 327 is provided with an injection port 220 and an ejection port 230. The injection port 220, disposed at an upper side of first developer transport route 327, is used to inject developer into the development unit 32. The ejection port 230, disposed at a lower side of first developer transport route 327, is used to eject developer from the development unit 32.

Further, magnetic sensor 240 is disposed on a lower side of the second developer transport route 328. The magnetic sensor 240 detects magnetic quantity of developer in the second developer transport route 328. The developer may be mainly composed of carrier particles (made of magnetic material) and toner particles (made of nonmagnetic material). Because the magnetic quantity of developer changes as a mixture ratio of carrier and toner changes, the magnetic sensor 240 detects a change of magnetic quantity of developer, by which developer concentration in the development unit 32 can be determined.

The injection port 220 and the ejection port 230 may be used to inject fresh developer into the development unit 32 and to eject used developer from the development unit 32. For example, developer injection may be conducted when the image forming apparatus 1 is delivered and installed at a user location, and developer ejection may be conducted when degraded developer is ejected from the development unit 32 for developer replacement.

FIG. 12 shows an example configuration that the developer container 400 is attached to the development unit 32 for developer injection or ejection.

Figure 12A:
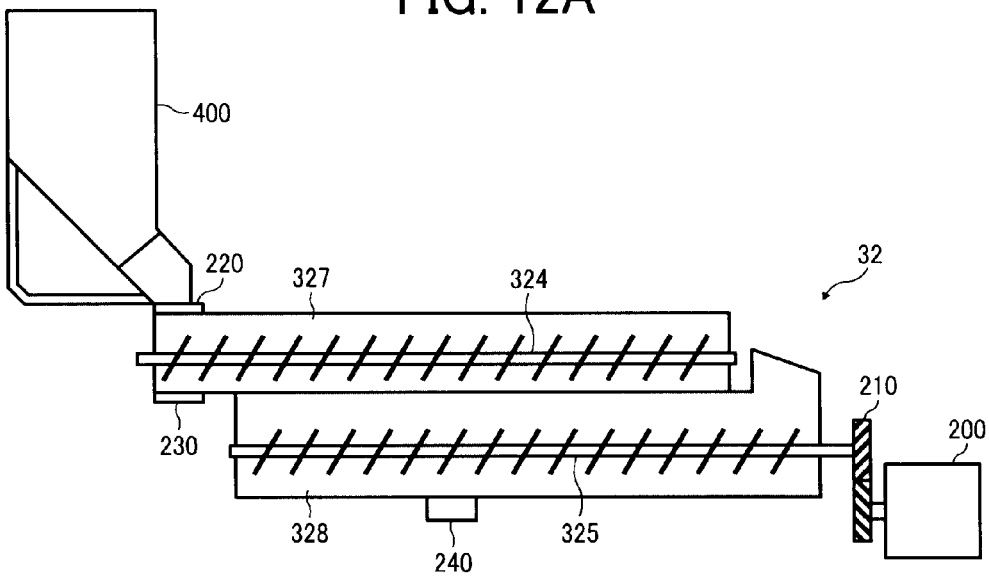
FIG. 12A illustrates a schematic configuration of attaching a developer vessel for developer injection to the development unit of FIG. 10.

When the developer is to be injected, the developer container 400 is attached to the injection port 220 in a downward direction as shown in FIG. 12A. As described later, the developer container 400 includes a mouth port 440, and the injection port 220 includes a shutter over an opening to close the opening. When the developer container 400 is attached to the injection port 220 by attaching the mouth port 440 to the injection port 220, the shutter is opened, by which developer can be injected into the development unit 32.

Figure 12B:
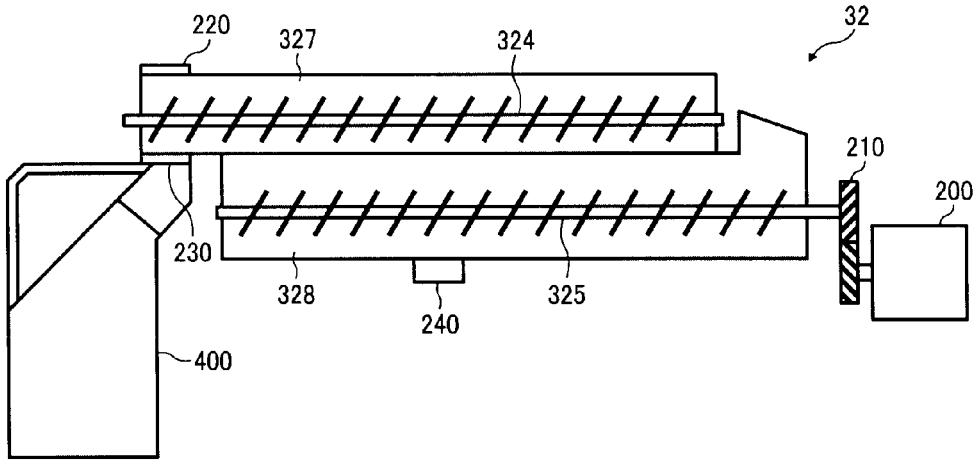
FIG. 12B illustrates a schematic configuration of attaching a developer vessel for developer ejection from the development unit of FIG. 10.

When the developer is to be ejected, the developer container 400 is attached to the ejection port 230 in a upward direction as shown in FIG. 12B. When the developer container 400 is attached to the ejection port 230 by attaching the mouth port 440 to the ejection port 230, the shutter is opened, by which developer can be ejected from the development unit 32.

As such, developer can be injected by attaching the developer container 400 to the injection port 220 in a downward direction, and then the transport screws 324-326 (324, 325, 326) is rotated to transport developer. In FIG. 12, developer may be transported from left to right in the first developer transport route 327 and the second developer transport route 328, and developer can be circulated in the development unit 32 by rotating the transport screws 324-326 as described above with reference to FIG. 2.

The injected developer is transported from an upstream side to a downstream side in the first developer transport route 327, and then to the third developer transport route 329 (see FIG. 2) through a descending route (not shown) set between the first developer transport route 327 and the third developer transport route 329. Then, developer is transported in the third developer transport route 329, and then to an upstream side of transport route of first developer transport route 327, and developer is transported through the first developer transport route 327. As such, developer can be circulated in the development unit 32.

Further, developer dropped from the first development roller 321 is recovered by the second transport screw 325, and transported in the second developer transport route 328. Then, developer is transported to an upstream side of third developer transport route 329. Then, developer is transported in the third developer transport route 329, and to the upstream side of first developer transport route 327. Then, developer is transported in the first developer transport route 327, by which developer is circulated. With such developer circulation, injected developer can be stored in the development unit 32.

Developer can be ejected from the development unit 32 by attaching the developer container 400 to the ejection port 230 in an upward direction, and then the transport screws 324-326 (324, 325, 326) are rotated to transport to-be-ejected developer. Transportation direction of the transport screws 324-326 is same as for developer injection, and thereby to-be-ejected developer is circulated as similar to injected developer. With such process, developer in the circulation route in the development unit 32 can be ejected to the developer container 400 through the ejection port 230.

Figure 13:
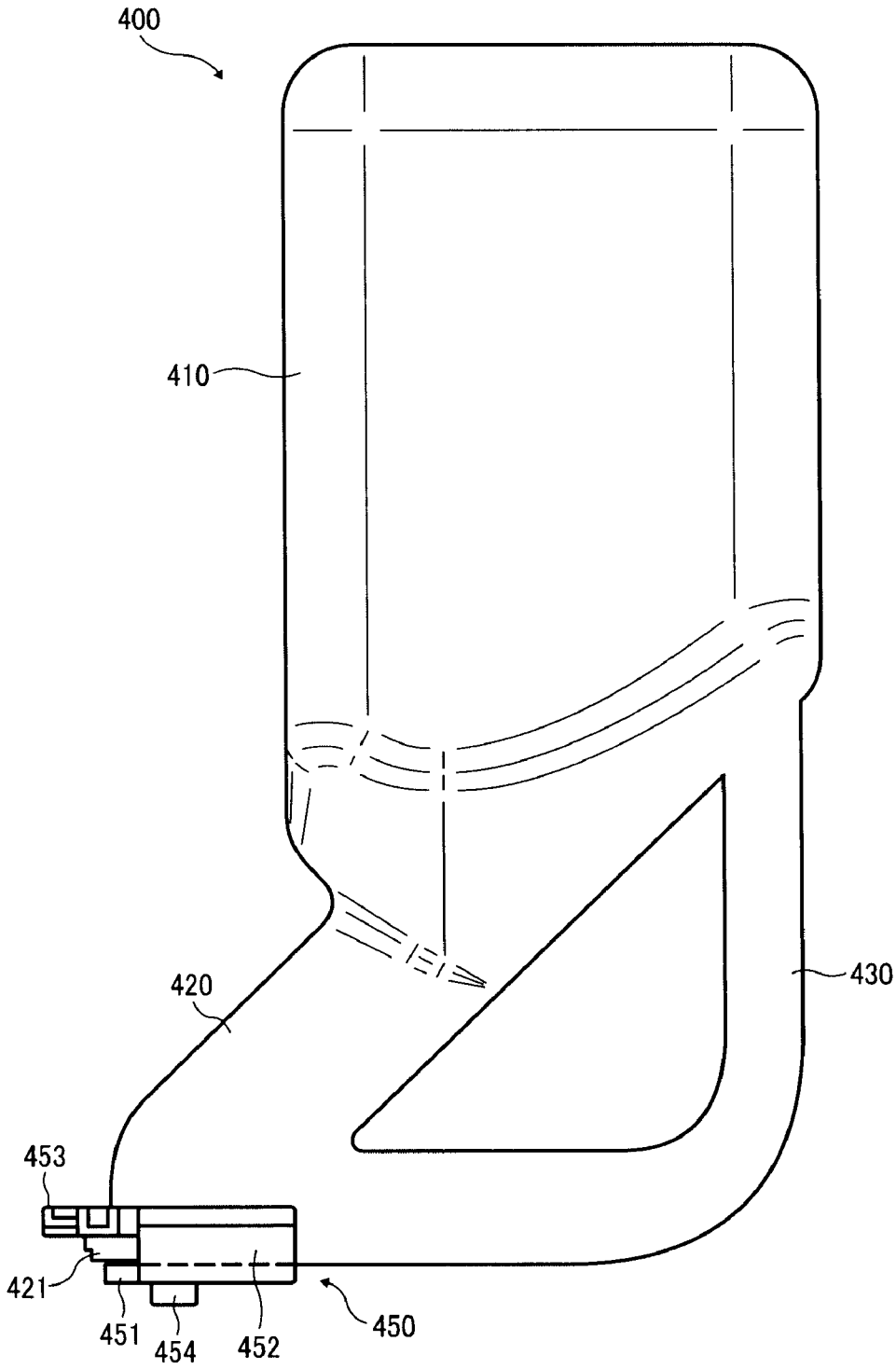
FIG. 13 illustrates a schematic configuration of developer vessel for developer injection and ejection.

A description is now given to the developer container 400 with reference to FIGS. 13 to 15. FIG. 13 shows an overview of the developer container 400, FIG. 14 shows a detail configuration of the container-side shutter 450 of the developer container 400, and FIG. 15 shows the developer container 400 attached to the development unit 32. As shown in FIG. 13, the developer container 400 includes a vessel body 410, an inclined transport section 420, and a grip 430, for example. The vessel body 410 may be shaped in a cubic-like shape, for example. The inclined transport section 420 may be a tube extending in a inclined manner from the vessel body 410. The grip 430, shaped in a L-shape form, may be extended between the vessel body 410 and the inclined transport section 420. The developer container 400 may be made of resin such as polyethylene. The developer container 400 may be formed of other materials and other shapes as required.

The inclined transport section 420 includes a mouth port 440 at the end of inclined transport section 420 (see FIG. 15). The mouth port 440 may be provided with a container-side shutter 450. The container-side shutter 450 may include a shutter plate 451, a guide member 452, a claw member 453, and a product-specific projection 454, for example. Further, the developer container 400 may include a projection member 421. These will be described later with reference to FIG. 14.

The inclined transport section 420 is used to transport developer in an inclined direction from or to the vessel body 410: when developer is injected to the development unit 32, developer moves from the vessel body 410 to the mouth port 440 through the inclined transport section 420, and is supplied to the development unit 32 through the mouth port 440; when developer is ejected from the development unit 32, developer moves from the development unit 32 to the inclined transport section 420 through the mouth port 440, and is recovered in the vessel body 410.

Figure 14A:
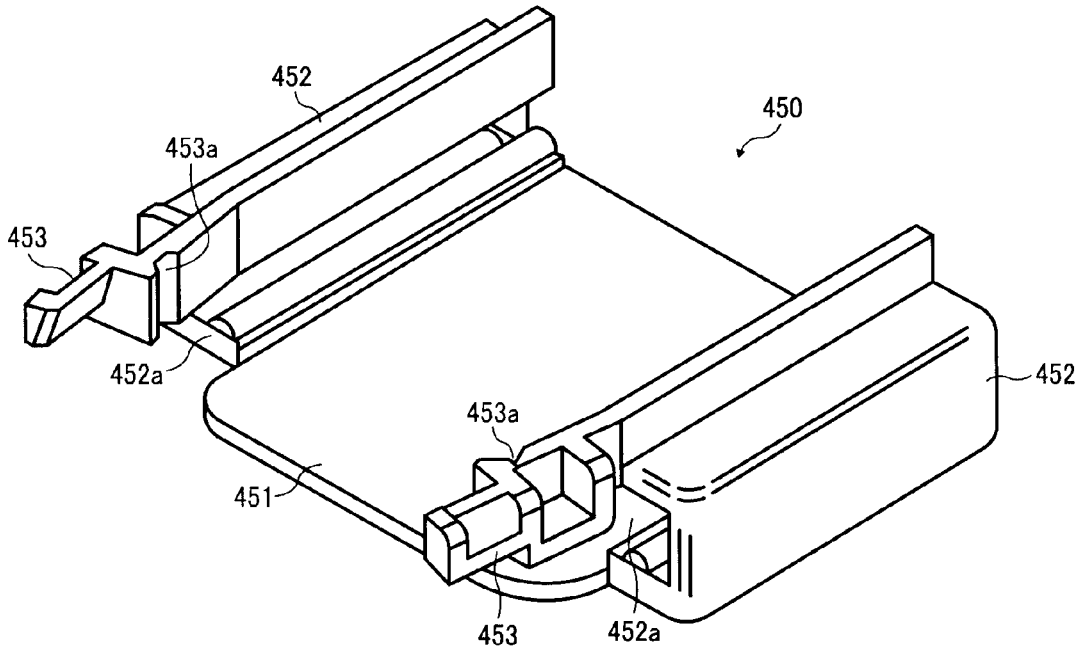
FIG. 14A illustrates a perspective view of a shutter set for developer vessel.
Figure 14B:
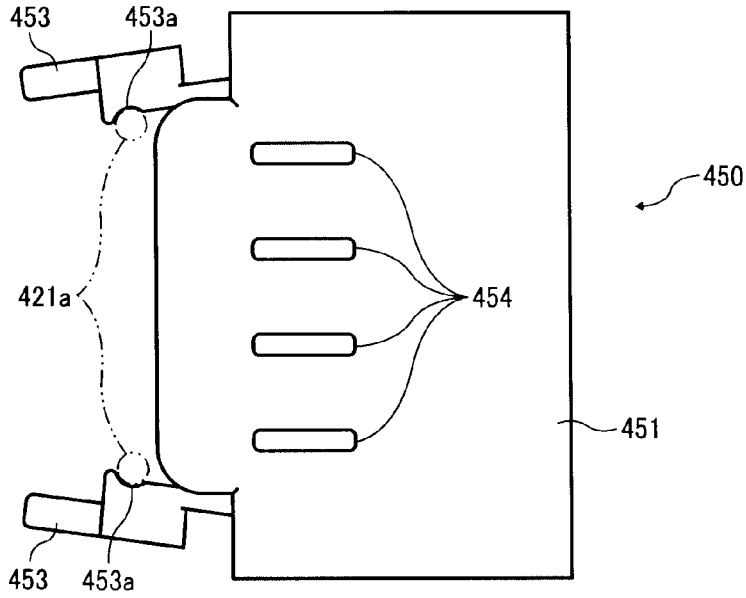
FIG. 14B illustrates a bottom view of the shutter.

As shown in FIGS. 14A and 14B, the container-side shutter 450 may include the shutter plate 451, the guide member 452, the claw member 453, and the product-specific projection 454. As shown in FIG. 15, the shutter plate 451 can cover the mouth port 440. The guide member 452, having a groove 452*a* therein, is disposed at both side of the shutter plate 451 to guide a movement of the container-side shutter 450.

At a proximity portion of the mouth port 440, a convex portion (not shown) is formed at both lateral side of the mouth port 440 for a length corresponding to a movement distance of the container-side shutter 450. The convex portion is fitted in the groove 452*a* of the container-side shutter 450. With such a configuration, the container-side shutter 450 can move with respect to the developer container 400 in a horizontal direction (left/right in FIG. 13). The container-side shutter 450 may be biased toward a left side in FIG. 13 using a bias member, by which the container-side shutter 450 is in a position to close the mouth port 440 when the developer container 400 is not attached to the development unit 32.

The claw member 453 is disposed at an edge of the guide member 452 to lock the container-side shutter 450 at a position closing the mouth port 440. The claw member 453 is formed of a concave portion 453*a* at its inside. The developer container 400 may have a pair of projected pins 421*a* formed on the developer container 400. When the concave portion 453*a* is engaged to the projected pin 421*a*, the container-side shutter 450 may be fixed at a given position.

As described later, when the developer container 400 is attached to the development unit 32, the claw member 453 is contacted to a wall of the development unit 32 and expanded by the wall the development unit 32, by which the claw member 453 is disengaged from the projected pin 421*a* and the locked condition of the container-side shutter 450 is released.

As shown in FIGS. 13 and 14B, the product-specific projection 454 may be formed on a bottom face of the shutter plate 451. The product-specific projection 454 may be shaped in different shapes depending on characters of developer such as type and color. Further, the product-specific projection 454 may be formed at one or more positions on the bottom face of the shutter plate 451, and shapes and an interval of positions may be differentiated depending on characters of developer such as type and color.

The injection port 220 of the development unit 32 may include one or more concaved portions to fit with the product-specific projection 454, in which the shape and the number of concaved portion may be corresponded to the shape and the number of the product-specific projection 454. Accordingly, the concaved portion formed on the injection port 220 of may be differentiated depending on characters of developer such as type and color.

Under such configuration, the developer container 400 can be securely attached to the development unit 32 when the concaved portion and the product-specific projection 454 can be fit completely. If the concaved portion and the product-specific projection 454 do not fit completely each other, the developer container 400 may not be attached to the development unit 32 securely. With such configuration, the developer container 400 used for one color may not be attached to the development unit 32 using another color, by which one color of developer may not be mixed with another color. Accordingly, the developer container 400 can be attached to the correct development unit 32, wherein such product-specific fitting configuration may be referred as fitting-compatibility.

On the contrary, as for the developer ejection from the development unit 32, such fitting-compatibility may not be required. Accordingly, concaved portions formed on the ejection port 230, used when ejecting developer, may be formed in a given shape, which can fit various types of the product-specific projection 454.

As shown in FIG. 15, the developer container 400 may include the projection member 421 and the hole 422 at the end of the mouth port 440, wherein the mouth port 440 is disposed at an end of the inclined transport section 420.

The projected pin 421*a* (see FIG. 14B) used to lock the container-side shutter 450 at a position closing the mouth port 440 is formed on both side of the projection member 421. Further, as described above, a pair of convex portions are formed at both side of the mouth port 440 in a horizontal direction so that the container-side shutter 450 can move in left and right direction of FIGS. 13 and 15. The mouth port 440 is set at the end of the inclined transport section 420.

Figure 15A:
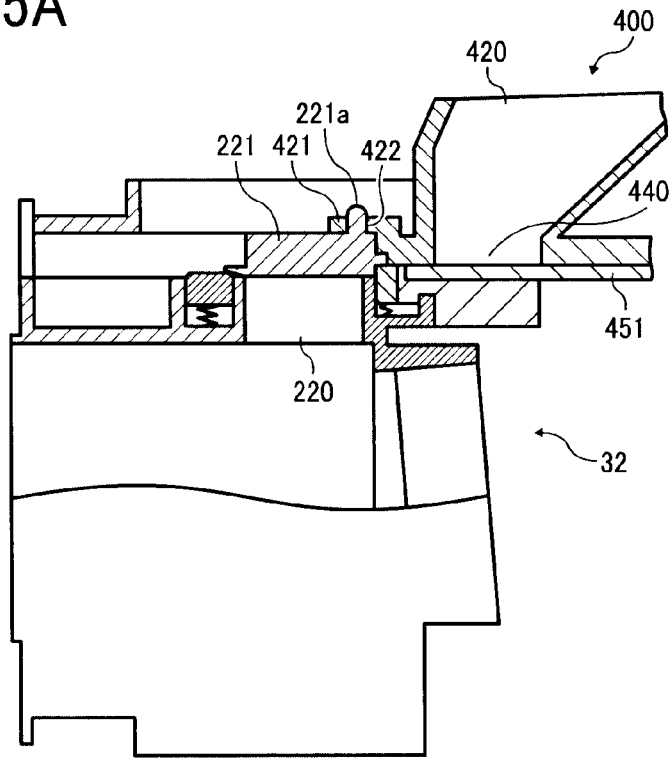
FIGS. 15A and 15B illustrate cross-sectional views of attached condition of the developer vessel and an injection port of the development unit.
Figure 15B:
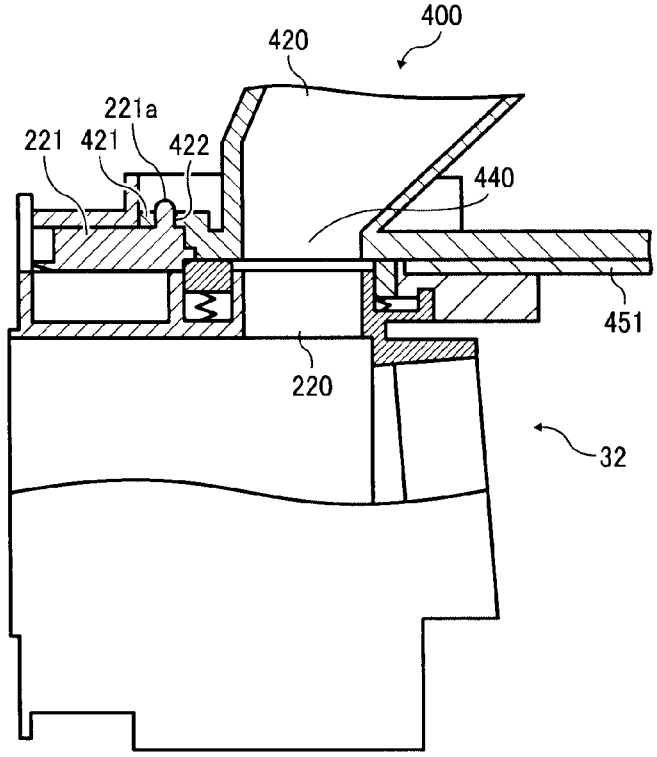
Figure 16:
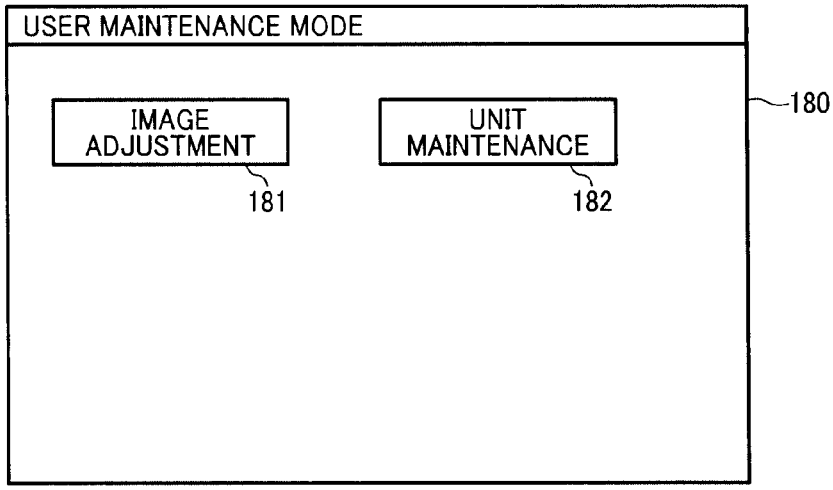
FIG. 16 shows a user maintenance screen for developer ejection.

FIGS. 15A and 15B show an example configuration when the developer container 400 is to be attached to the development unit 32. The injection port 220 of the development unit 32 includes an injection port shutter 221, which is moveable in a horizontal direction (in left and right direction in FIG. 15) along a guide member (not shown). The injection port shutter 221 has an upper face provided with a fittable member 221*a* to be fit in the hole 422 of the developer container 400. The injection port shutter 221 may be biased in a right direction in FIG. 15 by a biasing member, and is positioned at a position to close the injection port 220 under a normal condition.

The injection port 220 may have a frame member (not shown) to attach and fit with the developer container 400, and a guide member (not shown) to guide a movement of the fitted developer container 400 in a left direction in FIG. 15. When the developer container 400 is attached to the injection port 220, the developer container 400 is placed on the frame member from upside and pushed to downward to fit in the frame member as shown in FIG. 15A.

In such configuration, an outer face of the projection member 421 of the developer container 400 is contacted to an outer face of the injection port shutter 221, and the fittable member 221*a* of the injection port shutter 221 is inserted and fit in the hole 422 of the projection member 421.

Further, the claw member 453 of the container-side shutter 450 contacts a wall of the development unit 32 at the frame member, by which the claw member 453 can be warped to an outward direction, and thereby the claw member 453 is unfit or disengaged from the projected pin 421*a*, and then the container-side shutter 450 is unlocked from the developer container 400.

When the developer container 400, placed as described above, is moved in a left direction in FIG. 15 while the leading portion of the shutter plate 451 of container-side shutter 450 is contacted to a wall of the injection port 220. In such configuration, the container-side shutter 450 is not moved, and thereby the mouth port 440 can be gradually opened as the developer container 400 is moved in a left direction in FIG. 15.

Simultaneously, an outer face of the projection member 421 of the developer container 400 is contacted to an outer face of the injection port shutter 221 of the injection port 220, and the injection port shutter 221 is pushed by the projection member 421 in a left direction in FIG. 15. Accordingly, the injection port 220 can be gradually opened as the developer container 400 is moved in a left direction in FIG. 15.

As shown in FIG. 15B, when the developer container 400 is further moved in a left direction, the mouth port 440 and the injection port 220 is completely aligned and opened, by which the developer container 400 and the development unit 32 are communicated with each other through the mouth port 440 and the injection port 220. When the developer container 400 is removed or separated from the injection port 220, an inverse process of the above-described opening process is conducted.

As such, as the developer container 400 is attached to the injection port 220, the container-side shutter 450 and the injection port shutter 221 of the development unit 32 can be opened interlockingly. Further, as the developer container 400 is removed or separated from the injection port 220, the container-side shutter 450 and the injection port shutter 221 can be closed interlockingly.

A description is now given to a maintenance work such as replacement of developer, which is conductable by a user.

When the user conducts replacement of developer, a mode for replacement of developer is called using the operation unit 9, and given processes are conducted. For example, the I/O controller 540 and the development unit driver 550 are used to activate the drive motor 200 to conduct developer injection or developer ejection using the developer container 400 attached to the development nit 32. The main controller 100 uses the developer concentration detector 560 and the magnetic sensor 240 to monitor developer concentration condition so that developer ejection or injection operation can be conducted correctly.

Specifically, output voltage of the magnetic sensor 240 may vary in a given range such as from 1V to 4V range, for example. In such a case, a developer-empty condition may be set to 1 V, which may be referred to a low level voltage, and a developer-full condition may be set to 4 V, which may be referred to as high level voltage.

When developer is injected in the development unit 32 of developer-empty condition, the output voltage of the magnetic sensor 240 may be the low level voltage of 1V (corresponding to developer-empty condition). Accordingly, when the output voltage of the magnetic sensor 240 is not the low level voltage, it is assumed that developer may exist in the development unit 32. If someone starts the developer injection operation under such condition, the main controller 100 may interrupt and stop such developer injection operation in a short time. With such configuration, trouble of the development unit 32 such as double or excessive injection of developer can be prevented.

Similarly, when the developer ejection operation is started under a condition that the output voltage of magnetic sensor 240 is the low level voltage, the main controller 100 may interrupt and stop the developer ejection operation in a short time. With such configuration, trouble of the development unit 32 such as driving of the development unit 32 having the developer-empty condition can be prevented.

A description is now given to an operation panel (e.g., touch panel) and an operation process for a developer ejection operation from the development unit 32 with reference to FIGS. 16 to 25. FIGS. 16 to 25 show an example operation panel (e.g., touch panel) used for developer ejection by a user, which may be referred to as the user-specific operation screen.

When replacement timing of developer is displayed on the display portion 91 of the operation unit 9, a user can conduct replacement of developer. Specifically, the user presses the application calling key 926 disposed on the operation key unit 92 of the operation unit 9. Then, the display portion 91 of the operation unit 9 displays the user maintenance mode screen 180 (screen of FIG. 16). The user maintenance mode screen 180 displays the image adjustment button 181 and the unit maintenance button 182. The replacement of developer can be conducted by selecting the unit maintenance button 182.

Figure 17:
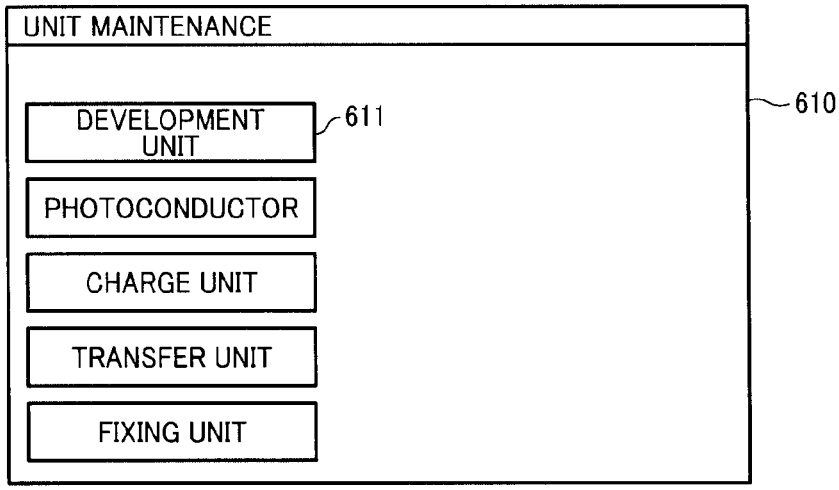
FIG. 17 shows a unit maintenance screen for developer ejection.

Then, a unit maintenance screen 610 is displayed (screen of FIG. 17). The unit maintenance screen 610 displays buttons set for process units such as development unit. In FIG. 17, the unit maintenance screen 610 displays "development unit," "photoconductor," "charge unit," "transfer unit," and "fixing unit" as examples of process units. The replacement of developer is a maintenance work for the development unit 32. Accordingly, a development unit button 611 is selected for replacement of developer.

Figure 18:
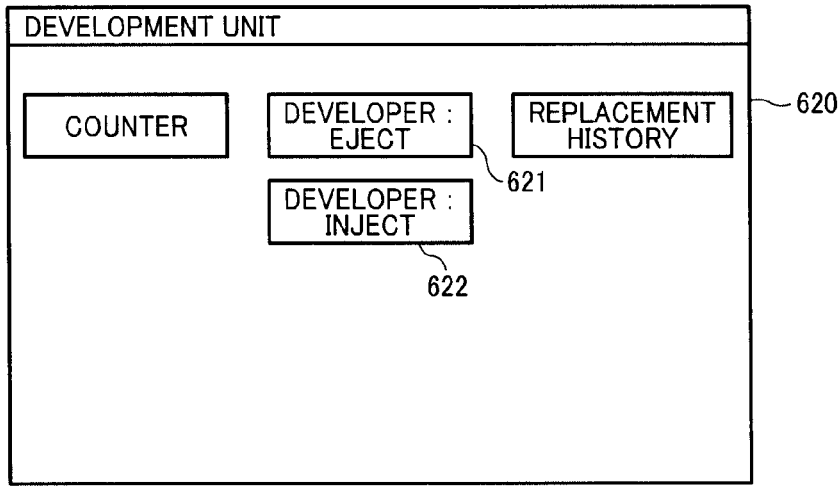
FIG. 18 shows a development unit maintenance screen for developer ejection.

Then, a maintenance screen 620 for the development unit is displayed (screen of FIG. 18). The maintenance screen 620 displays an ejection button 621 and an injection button 622 for replacement of developer. When developer is to be ejected, the "developer:eject" button 621 is selected.

Figure 19:
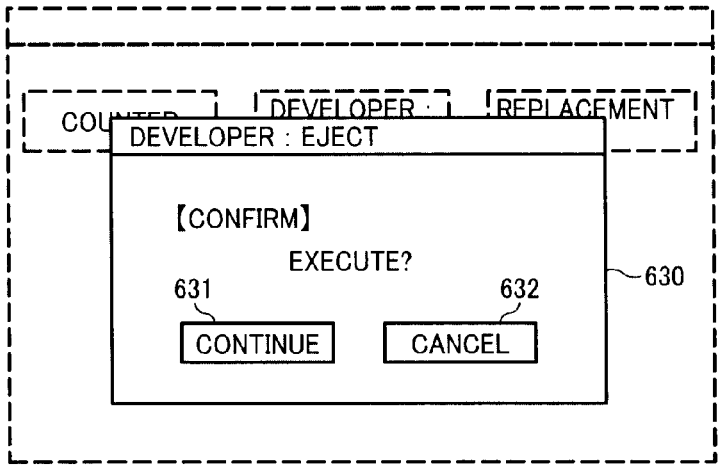
FIG. 19 shows a developer ejection confirmation screen for developer ejection.
Figure 20:
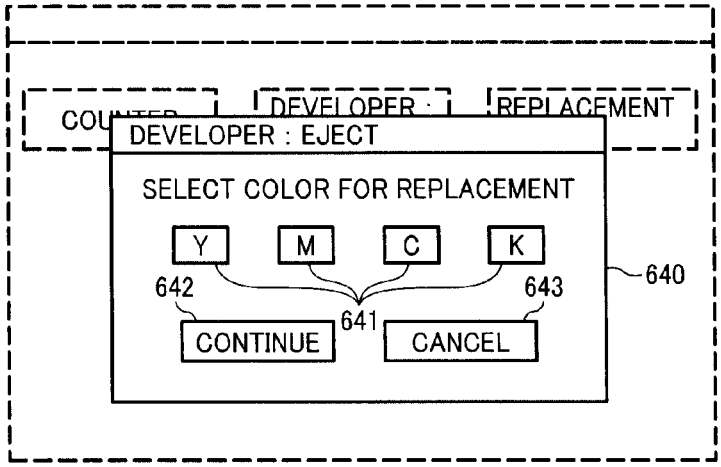
FIG. 20 shows a development unit selection screen for developer ejection.
Figure 21:
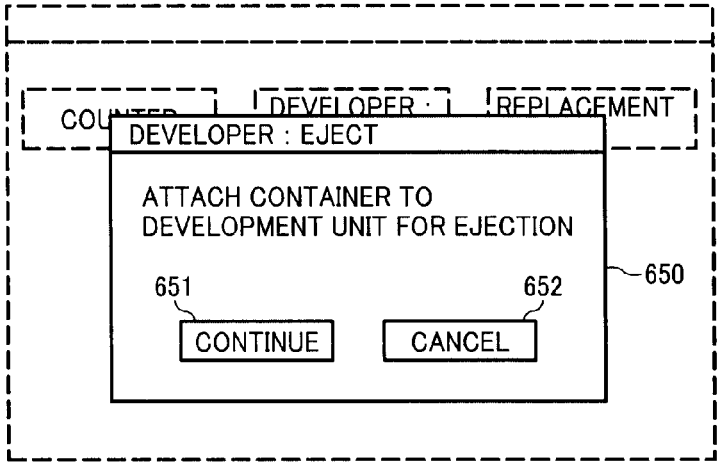
FIG. 21 shows a developer vessel attachment request screen for developer ejection.

Then, a confirmation screen 630 having a "continue" button 631 and a "cancel" button 632 is displayed to confirm whether developer ejection is to be executed (screen of FIG. 19). The user selects the "continue" button 631 for executing the developer ejection. The user can select the "cancel" button 632 to cancel the developer ejection and stop the process when the user wants to cancel the process due to some reasons.

When the "continue" button 631 is selected, a selection screen 640 (screen of FIG. 20) is displayed, which is used to identify the development unit 32 for developer ejection. The selection screen 640 displays color button 641 including color selection buttons corresponded to each of colors used for the development units 32, by which the development unit 32 to be executed for developer replacement operation can be identified.

Accordingly, the user can select the development unit 32 to be executed for developer ejection by selecting the color button 641. The color buttons 641 may be colored with each of colors Y, M, C, K (yellow, magenta, cyan, black). With such a configuration, the user can select the development unit 32 to be executed for developer ejection with a visual sign (i.e., color), by which the user can efficiently select the development unit 32 without selection mistakes.

In many cases, when the developer ejection is conducted, the developer injection may be subsequently conducted for developer replacement.

The selection screen 640 can display a message for selecting color corresponded to developer replacement, by which the selection screen 640 can be used both of developer ejection and injection operation. Instead of such commonly applicable message, different messages can be set for each of the developer ejection and injection operation.

When the user selects the color, the user may select a "continue" button 642. The user can select a "cancel" button 643 to stop the process when the user wants to cancel the process due to some reasons.

When the continue button 642 is selected, a request screen 650 is displayed (screen of FIG. 21) to request an attachment of the developer container 400 to the development unit 32 to conduct the developer ejection. The request screen 650 requests the user to execute the developer ejection operation. The request screen 650 displays a message requesting an attachment of the developer container 400 to the development unit 32, a "continue" button 651, and a "cancel" button 652. The above-described screens display selection/input symbols of information, selectable by a user. On one hand, the request screen 650 requests a given action such as attachment of the developer container 400 to the user. When the user conducts such requested action, the "continue" button 651 is pressed. As such, when the request screen 650 requesting the user to conduct the given action for the user-maintenance work is displayed, an input screen for inputting an instruction for executing a given operation may be displayed based on an assumption that the given action is actually conducted as requested.

When the request screen 650 is displayed, the user attaches the developer container 400 of empty-condition to the development unit 32 to prepare for a developer ejection operation. Then, the user selects the "continue" button 651. The user can cancel the developer ejection by selecting a "cancel" button 652 when the user wants to cancel the process due to some reasons.

Figure 22:
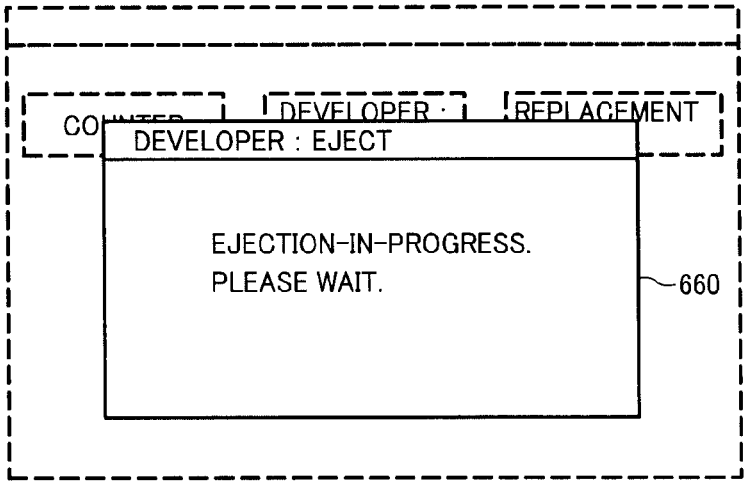
FIG. 22 shows an ejection in-progress screen for developer ejection.

Then, the developer ejection operation is started and an ejection-in-progress screen 660 is displayed (screen of FIG. 22). Once the developer ejection operation is started, the user cannot interrupt and stop the in-progress developer ejection operation, and the apparatus does not stop until the completion of developer ejection operation. With such configuration, the developer ejection can be effectively conducted. If the developer ejection can be effectively conducted, fresh developer can be injected into the development unit 32 by a subsequent injection process effectively, by which developer amount stored in the development unit 32 can be assured at a preferable level.

Further, in the replacement of developer, the developer maintenance counter (or developer counter) may be initialized (or reset), wherein a value of the developer maintenance counter indicates used-frequency of developer. For example, when the developer ejection operation is started, the developer maintenance counter is initialized at the same time so that initialization can be securely conducted.

When the developer ejection operation is completed, a result screen is displayed. Whether the developer ejection operation is completed correctly can be determined by monitoring the output voltage of magnetic sensor 240. Specifically, an ejection time and the output voltage of magnetic sensor 240 may be used for determining whether the developer ejection operation is completed correctly. For example, if the output voltage of magnetic sensor 240 becomes a low level voltage within a given time, it is determined that the developer ejection operation is completed correctly.

Figure 23:
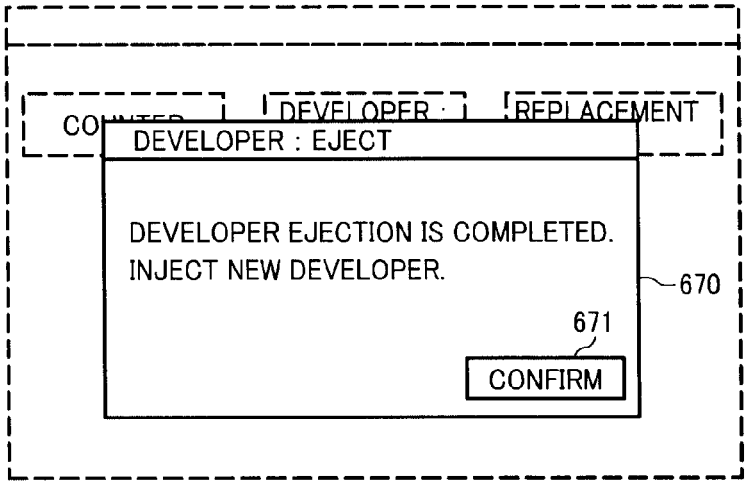
FIG. 23 shows a correctly-completed ejection screen for developer ejection.

When the developer ejection operation is completed correctly, a normal end screen 670 is displayed to end the developer ejection mode (screen of FIG. 23). The normal end screen 670 includes a confirmation button 671. When the confirmation button 671 is pressed, a maintenance work screen 690 (screen of FIG. 25) for the development unit is displayed. In the normal end screen 670, a "developer:eject" button 691 is displayed by inverting a display style, by which correctly-completed developer ejection operation is can be recognized.

Figure 24:
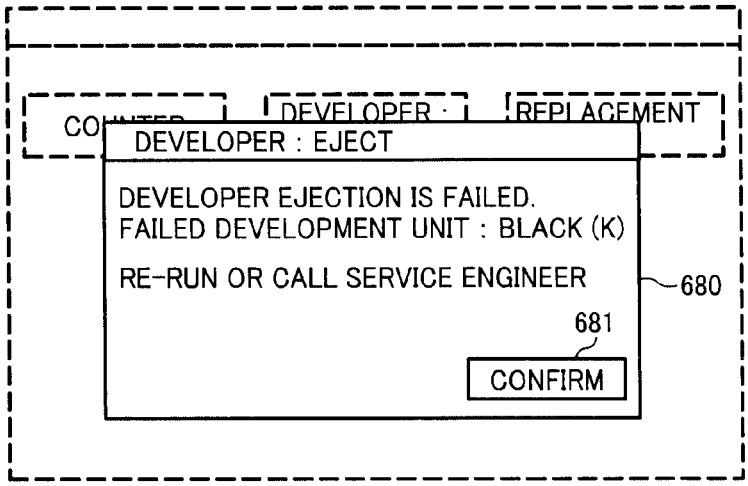
FIG. 24 shows an incorrectly-completed ejection screen for developer ejection.
Figure 25:
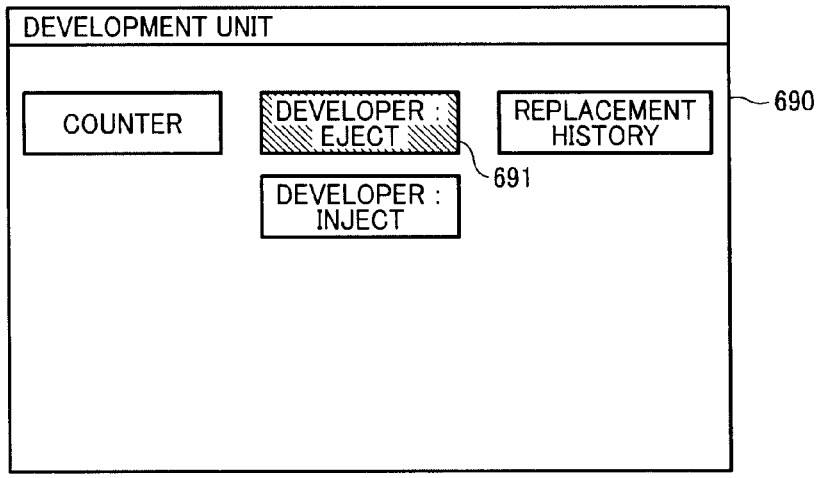
FIG. 25 shows a development unit maintenance screen for developer ejection.

When the developer ejection operation is not completed correctly, the abnormal-end screen 680 is displayed so that the user is notified that the concerned or selected development unit 32 is failed for developer ejection operation, and the developer ejection mode is ended (screen of FIG. 24). When a user recognizes abnormal situation, the user can conduct situation-solving measures such as re-running of the ejection process or calling a service engineer, for example.

When a "confirmation" button 681 is pressed in the abnormal-end screen 680, the maintenance screen 620 (screen of FIG. 18) for development unit is displayed. In this maintenance screen 620, the "developer:eject" button 621 is displayed without the inversion of display style, by which a user can recognize that the process is not completed correctly. By checking information indicating abnormal-situation, the user can conduct situation-solving measures such as re-running of the ejection process or calling a service engineer, for example.

When the developer ejection operation is completed correctly (see screen of FIG. 25), the developer injection process for injecting new developer may be subsequently conducted. A user can conduct the developer injection operation in a similar manner of developer ejection operation.

When the developer injection process is not conducted after the developer ejection operation, followings may be conducted: the "developer:injection" button 691 is selected in the maintenance work screen 690 (see FIG. 25) to display a confirmation screen, similar to the screen of FIG. 19, to confirm whether the developer injection process is to be conducted, and then a "cancel" button is selected.

Further, a screen which can conduct only the developer ejection operation but dose not conduct the developer injection process can be set. Such screen may be a screen disposing an "end" button on the screen of FIG. 23.

Figure 26:
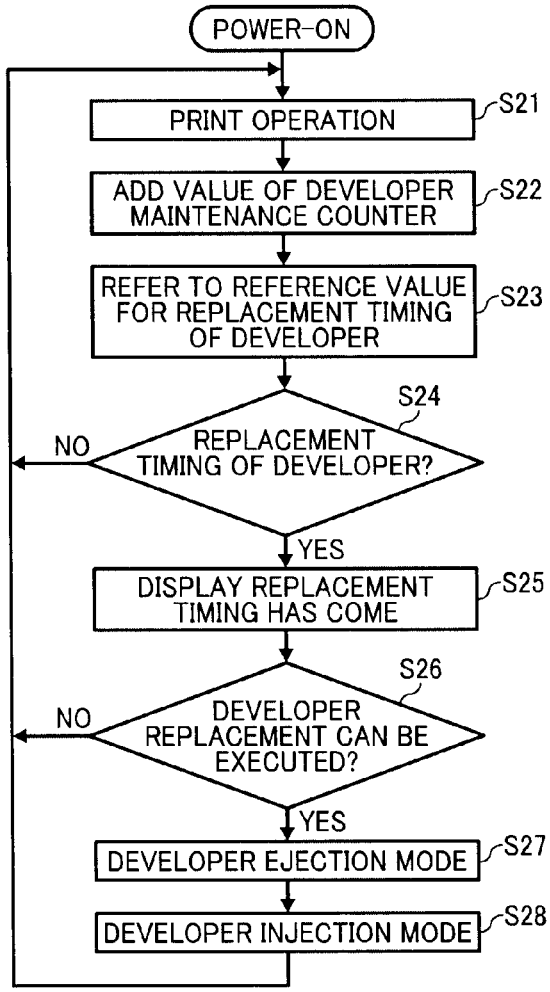
FIG. 26 shows a flowchart for developer injection and ejection.

A description is now given to a process flow for developer injection and ejection according to an example embodiment with reference to FIG. 26. FIG. 26 shows a flowchart for one unit maintenance work such as developer replacement for the development unit 32, in which when developer replacement timing is recognized, developer is ejected, and fresh developer is injected subsequently.

When a main power is supplied to the image forming apparatus 1, the image forming apparatus 1 is activated and set in the stand-by condition, in which the image forming apparatus 1 wait an user instruction or a print request from a remote apparatus, for example.

When an print operation is conducted (step S21), value of the developer maintenance counter is incremented or added for the concerned development unit 32 depending on the number of printed sheet (step S22), and reference value set for determining replacement timing of developer is referred (step S23). Then, the reference value for determining replacement timing of developer is compared with the presently-set value to determine whether developer replacement timing has come (step S24). The number of printed sheet may be counted as the number of A4-sized sheet, for example. If the sheet size is A3-sized sheet, one A3 sheet is counted as two A4 sheets, which may be referred as two-times count. The reference value set for determining replacement timing of developer may be set in the main controller 100 as a given number of printed sheets If the presently-set value is below the reference value for determining replacement timing of developer, the process goes back to the stand-by condition (No at step S24).

If a presently-set value is greater than the reference value for determining replacement timing of developer (YES at step S24), the display portion 91 of the operation unit 9 displays that replacement timing has come (step S25). When the user confirms the replacement timing of developer by viewing the display portion 91, the user determines whether replacement of developer can be executed under a present apparatus condition such as in-progress printing condition or the like (step S26).

If the user determines that replacement of developer can be executed (YES at step S26), the developer ejection mode (step S27) and a developer injection mode (step S28) are executed to conduct the replacement of developer as maintenance work.

If the user determines that replacement of developer cannot be executed under a present apparatus condition immediately (NO at step S26), a message indicating "developer replacement is in need" may be displayed whenever the print operation is conducted to notify the replacement timing of developer to the user repeatedly (step S25).

Figure 27:
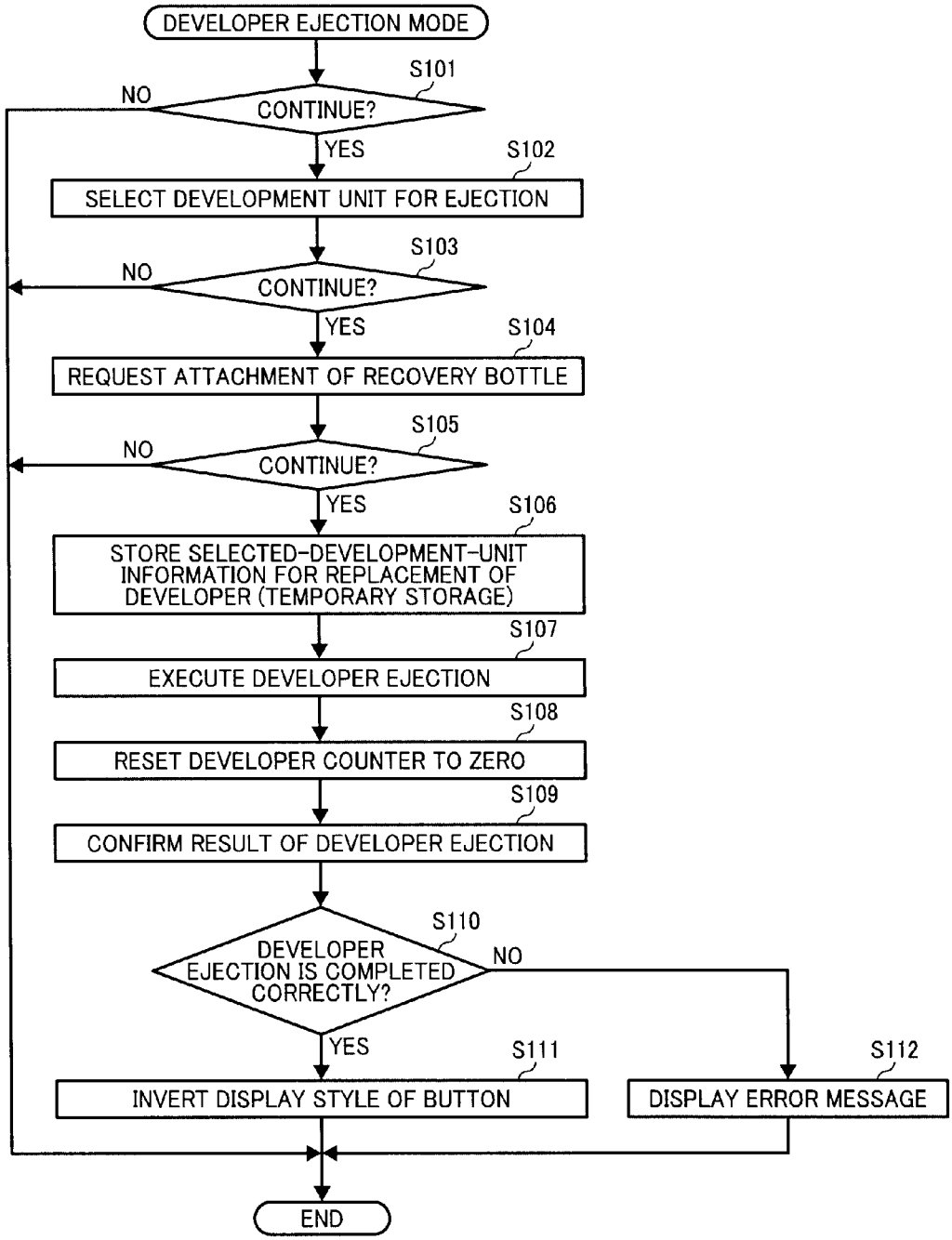
FIG. 27 shows a flowchart for developer ejection mode for developer ejection operation.

FIG. 27 shows a flowchart for process flow of the developer ejection mode used for developer ejection operation. When the "developer:eject" button 621 is pressed on the maintenance screen 620 set for the development unit (screen of FIG. 18), a developer ejection mode is started, and the confirmation screen 630 (screen of FIG. 19) is displayed, in which it is checked whether a developer ejection operation is to be conducted (step S101).

If the "cancel" button 632 is selected (NO at step S101), the developer ejection mode is ended. Such ending process is conducted when the "cancel" button 632 is selected at other subsequent steps.

If the continue button 631 is selected (YES at step S101), the selection screen 640 (screen of FIG. 20) is displayed to display which development unit needs replacement of developer. In the selection screen 640, the development unit 32, which needs replacement of developer, is selected (step S102), wherein the selected development unit 32 needs the developer ejection operation. If the continue button 642 is selected (YES at step S103), the request screen 650 (screen of FIG. 21) is displayed (step S104) to request an attachment of the developer container 400 (used as recovery bottle) to the selected development unit 32 to recover developer.

If the continue button 651 is selected on the request screen 650 (YES at step S105), information of selected development unit which needs replacement of developer is stored in the storage 120 of the main controller 100 as temporary storage (step S106). Then, the developer ejection operation is conducted for the selected development unit 32 (step S107). During the developer ejection operation, the ejection-in-progress screen 660 (screen of FIG. 22) is displayed.

Then, the developer maintenance counter for the concerned development unit 32 is reset to zero (step S108), and result of the developer ejection operation is checked or confirmed (step S109).

The result of the developer ejection operation can be determined by checking the output voltage of the magnetic sensor 240. For example, it is checked whether the output voltage of the magnetic sensor 240 becomes the low level voltage (corresponding to developer-empty condition).

If the developer ejection operation is completed correctly (YES at step S110), the normal end screen 970 (screen of FIG. 23) is displayed to indicate developer ejection operation is completed correctly. Then, the maintenance screen 620 (screen of FIG. 18) of the development unit displays the "developer:eject" button 621 by inverting a display style (step S111), and then the developer ejection mode is ended. Specifically, if the confirmation button 671 is selected on the normal end screen 670, the maintenance work screen 690 of the development unit (screen of FIG. 25) is displayed while the "developer:eject" button 691 is displayed inverting display style (step S111).

If the developer ejection operation is not completed correctly (NO at step S110), the abnormal-end screen 680 (screen of FIG. 24) is displayed (step S112), and the developer ejection mode is ended without inverting display style of the "developer eject" button 621. Specifically, if the confirmation button 681 is selected on the abnormal-end screen 680, the maintenance screen 620 of the development unit (screen of FIG. 18) is displayed while the "developer: eject" button 621 is displayed without inverting display style (step S111).

Figure 28:
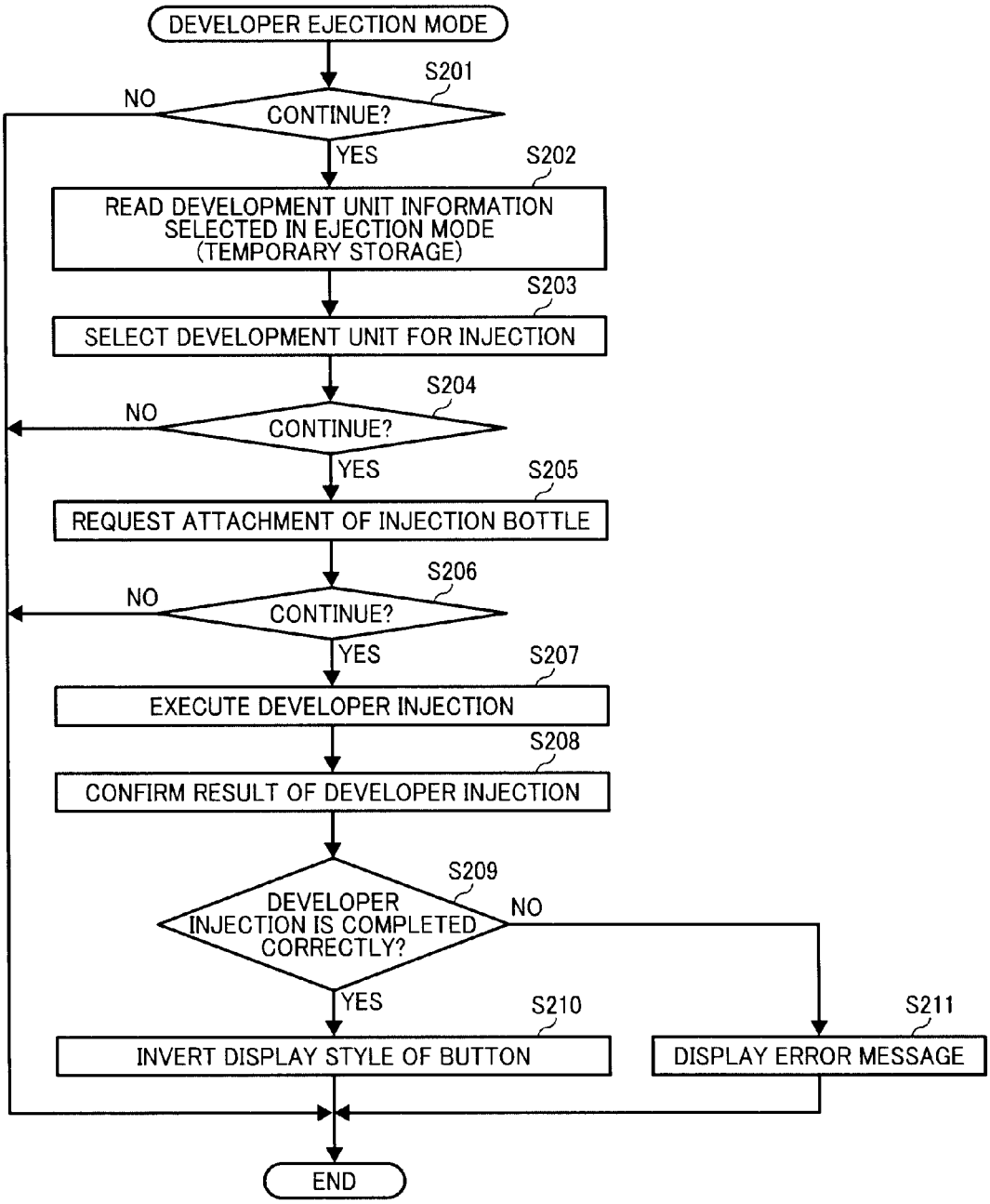
FIG. 28 shows a flowchart for developer injection mode for developer injection operation.

FIG. 28 shows a flowchart for process flow of the developer injection mode used for developer injection operation. The developer injection mode can be conducted using an operation panel (e.g., touch panel) used for the developer ejection mode.

When the developer ejection operation is completed correctly, the maintenance work screen 690 (screen of FIG. 25) is displayed. If the "developer injection" button is pressed on the maintenance work screen 690 set for the development unit, the developer injection mode is started, in which a developer injection screen is displayed to confirm whether the developer injection operation is to be executed (step S201).

If the "cancel" button is selected (NO at step S201), the developer injection mode is ended. Such ending process is conducted when the "cancel" button is selected at other subsequent steps.

If the "continue" button is selected, selected color information, stored as temporary storage when the developer ejection mode is conducted, is read (step S202), and a screen displaying the development unit 32 corresponding to selected color information, is displayed as a development unit 32 for developer replacement.

In such screen, the development unit 32 for developer replacement (or the development unit 32 for developer injection) is selected (step S203). If the "continue" button selected (YES at step S204), a screen requesting an attachment of the developer container 400 (use as injection bottle) having fresh developer is displayed (step S205). If the "continue" button is selected on this requesting screen (YES at step S206), the developer injection operation is executed for the selected development unit 32 (step S207). During the developer injection operation, the injection-in-progress screen is displayed. Then, the result of developer injection operation is confirmed (step S208).

The result of developer injection operation can be determined by checking the output voltage of the magnetic sensor 240. For example, if the output voltage of the magnetic sensor 240 becomes the high level voltage (corresponding developer-full condition) or a given output voltage corresponding to a given target injection amount, it is determined that developer injection process is completed correctly (YES at step S209).

Then, a normal end screen showing a message that the developer injection is completed correctly is displayed, and the maintenance screen 620 is displayed while inverting the display style of the "developer injection" button 622 (step S210), and the developer injection mode is ended. As such, if a "confirmation" button is selected on the normal end screen, the maintenance screen 620 is displayed while inverting the display style of the "developer injection."

If the developer ejection operation is not completed correctly (NO at step S209), an abnormal end screen is displayed with an error message (step S211), and the developer injection mode is ended without inverting the display style of "developer injection" button 622. If a "confirmation" button is selected on the an abnormal end screen, the maintenance screen 620 is displayed without inverting the display style of "developer:injection" button 622.

In the above-described embodiment, developer ejection is conducted at first, and the developer injection is subsequently conducted. Similar process can be applied when the developer injection operation is conducted without conducting the developer ejection operation, in which the developer:injection" button 622 is pressed on the maintenance screen 620 (screen of FIG. 18), for example.

Although the above-described example embodiments describe maintenance such as adjustment of image forming position on sheet and developer replacement conductable by a user, maintenance which can be applied with the present invention may not limited these, but the present invention can be applied to other maintenance, as required.

In the above-described example embodiment, maintenance work that is conducted by a user is limited to a given range that prevents a damage risk related to maintenance work, by which a usability can be enhanced while preventing damage to an image forming apparatus.

Further, an adjustment range settable by a user is set narrower than an adjustment range settable by a service engineer, and further, an adjustment range settable by a user and an adjustment range settable by a service engineer is set by a common data/information configuration to conduct adjustment with a common procedure, by which a simpler configuration can be used.

Further, an adjustment range settable by user-setting function and an adjustment range settable by service-setting function can be set independently operable, by which settings can be conducted with various manners, by which freedom of settings can be enhanced.

In the above-described example embodiment, an operation panel can be used for maintenance work conductable by a user. The user can conduct maintenance work using user-specific adjustment range (or user adjustment range, user-allowed-operation content), which is differentiated from service engineer-specific adjustment range (or service adjustment range, service-operation content), by which a usability can be enhanced while preventing damage to an image forming apparatus.

Numerous additional modifications and variations are possible in light of the above teachings. It is therefore to be understood that within the scope of the appended claims, the disclosure of the present invention may be practiced otherwise than as specifically described herein. For example, elements and/or features of different examples and illustrative embodiments may be combined each other and/or substituted for each other within the scope of this disclosure and appended claims.

What is claimed is:

1. An image forming apparatus including a maintenance function for maintaining the image forming apparatus in a given operating condition, comprising:

a device to form an image;

an operation screen unit useable for conducting maintenance on the image forming apparatus, the maintenance being categorized into service-maintenance work conductable by a service engineer within a range of service operations (service-operation content) and user-maintenance work conductable by a user within a range of user-allowed operations (user-allowed-operation content), wherein the operation screen unit includes a user-specific operation screen that displays the user-allowed-operation content, with which the user-maintenance work is conductable for adjusting the maintenance function within the user-allowed-operation content, wherein the user-allowed-operation content and the service-operation content are different, and wherein the user-allowed-operation content, used as a user-adjustment range for a parameter adjustable by the user, is used to control the image forming apparatus, and the user-adjustment range is different from a service-adjustment range for the parameter which is adjustable by a service engineer.

2. The image forming apparatus according to claim 1, wherein the user-allowed-operation content, adjustable by the user for the maintenance function, is limited in a given range that does not cause damage risk to the image forming apparatus when the user maintenance work is conducted.

3. The image forming apparatus according to claim 1, wherein the user-allowed-operation content, differentiated from the service-operation content, is set as a user-adjustment range for the user maintenance work, the service-operation content is set as a service-adjustment range for the service maintenance work, and the user-adjustment range and the service-adjustment range are used as an adjustment range for the maintenance function.

4. The image forming apparatus according to claim 1, wherein the user-adjustment range is set narrower than the service-adjustment range.

5. The image forming apparatus according to claim 1, wherein the user-adjustment range and the service-adjustment range are configured with a common data/information configuration to conduct adjustment with a common procedure.

6. The image forming apparatus according to claim 1, wherein the parameter is a numeric value.

7. An image forming apparatus, comprising:

a device to form an image;

a device to perform a user-setting function which sets one or more selections as operating parameters of the image forming apparatus as a user adjustment range, the selections adjustable by a user in view of apparatus-use environment; and a device to perform a service-setting function to set one or more selections as operating parameters of the image forming apparatus as a service adjustment range, the selections adjustable by a service engineer in view of service maintenance work conductable by the service engineer, wherein the selections settable by the user-setting function at least partially correspond to the selections set by the service-setting function, and the user adjustment range and the service adjustment range are independently operable for setting one or more selections, and wherein the user-adjustment range is used to set an operating parameter for the image forming apparatus by the user, and the user-adjustment range is different from the service-adjustment range for the operating parameter which is adjustable by the service engineer.

8. An image forming apparatus, comprising:

a device to form an image;

means for performing a user-setting function which sets one or more selections as operating parameters of the image forming apparatus as a user adjustment range, the selections adjustable by a user in view of apparatus-use environment; and means for performing a service-setting function to set one or more selections as operating parameters of the image forming apparatus as a service adjustment range, the selections adjustable by a service engineer in view of service maintenance work conductable by the service engineer, wherein the selections settable by the user-setting function at least partially correspond to the selections set by the service-setting function, and the user adjustment range and the service adjustment range are independently operable for setting one or more selections, and wherein the user-adjustment range is used to set an operating parameter for the image forming apparatus by the user, and the user-adjustment range is different from the service-adjustment range for the operating parameter which is adjustable by the service engineer.

* * * * *